US009295334B2

(12) United States Patent
Olarte

(10) Patent No.: US 9,295,334 B2
(45) Date of Patent: Mar. 29, 2016

(54) HINGE MECHANISM WITH NON-CYLINDRICAL PIN

(75) Inventor: Alvaro Mauricio Olarte, Aventura, FL (US)

(73) Assignee: SERIES INTERNATIONAL, LLC, Aventura, FL (US)

( * ) Notice: Subject to any disclaimer, the term of this patent is extended or adjusted under 35 U.S.C. 154(b) by 378 days.

(21) Appl. No.: 13/601,027

(22) Filed: Aug. 31, 2012

(65) Prior Publication Data

US 2013/0057036 A1 Mar. 7, 2013

Related U.S. Application Data

(60) Provisional application No. 61/531,476, filed on Sep. 6, 2011.

(51) Int. Cl.

| | |
|---|---|
| ***A47C 7/58*** | (2006.01) |
| ***A47C 1/121*** | (2006.01) |
| ***E05D 5/12*** | (2006.01) |
| ***E05D 5/14*** | (2006.01) |

(Continued)

(52) U.S. Cl.

CPC . *A47C 7/58* (2013.01); *A47C 1/121* (2013.01); *E05D 5/12* (2013.01); *E05D 5/14* (2013.01); *E05D 7/1061* (2013.01); *E05D 2005/106* (2013.01); *E05Y 2900/60* (2013.01); *Y10T 16/54* (2015.01); *Y10T 16/5406* (2015.01); *Y10T 16/557* (2015.01)

(58) Field of Classification Search

USPC ..... 297/313, 331, 332, 335; 16/231, 224

See application file for complete search history.

(56) References Cited

U.S. PATENT DOCUMENTS

| | | | |
|---|---|---|---|
| 1,810,888 | A | 11/1930 | Hanson |
| 2,000,172 | A | 5/1935 | Hanson |

(Continued)

FOREIGN PATENT DOCUMENTS

| | | | |
|---|---|---|---|
| GB | 180054 | A | 5/1922 |
| JP | 2012249948 | A | 12/2012 |

OTHER PUBLICATIONS

International Search Report and Written Opinion of the International Searching Authority Application No. PCT/US2012/053756 Completed: Nov. 12, 2012; Mailing Date: Nov. 23, 2012 13 pages.

(Continued)

*Primary Examiner* — David R Dunn
*Assistant Examiner* — Timothy J Brindley
(74) *Attorney, Agent, or Firm* — St Onge Steward Johston and Reens LLC

(57) ABSTRACT

An improved seating hinge includes a pin having a race member at a distal end and a shaft at a proximal end, and a bracket having a socket, wherein the pin is inserted into the bracket so that the race member is in contact with the socket, the shaft protrudes from the socket, and the pin is rotatable within the socket. The seating hinge further includes a telescoping connection that allows for varying seat widths and placements. Adjustment and/or alignment of the seat bottom can be performed without requiring support leg to be moved or replaced. The hinge can accommodate an auditorium having both straight sections of seating and curved sections of seating with varying degrees of curvature, where some support legs are mounted parallel and others non-parallel relative to each other. The hinge design can withstand weather and elements such as those present in many outdoor locations.

44 Claims, 18 Drawing Sheets

(51) Int. Cl.

| | |
|---|---|
| ***E05D 7/10*** | (2006.01) |
| *E05D 5/10* | (2006.01) |

(56) References Cited

U.S. PATENT DOCUMENTS

| | | | | | |
|---|---|---|---|---|---|
| 2,070,387 | A | | 2/1937 | Vandervoort | |
| 2,304,223 | A | | 12/1942 | Westrope | |
| 2,621,709 | A | | 4/1948 | Bell | |
| 3,641,614 | A | * | 2/1972 | Newsome | 15/250.32 |
| 3,714,678 | A | * | 2/1973 | Weisz et al. | 16/224 |
| 3,727,975 | A | | 4/1973 | Anderson | |
| 3,813,149 | A | | 5/1974 | Lawrence, III et al. | |
| 4,632,457 | A | * | 12/1986 | Hofrichter et al. | 297/335 |
| 4,854,640 | A | * | 8/1989 | Yokoyama | 297/333 |
| 4,864,690 | A | * | 9/1989 | Chen | 16/276 |
| 5,308,126 | A | | 5/1994 | Weger, Jr. et al. | |
| 5,601,335 | A | | 2/1997 | Woods et al. | |
| 5,803,546 | A | | 9/1998 | Yamazaki | |
| 5,881,431 | A | | 3/1999 | Pieper, II et al. | |
| 5,899,531 | A | * | 5/1999 | Koehler | 297/335 |
| 6,024,397 | A | * | 2/2000 | Scraver et al. | 296/65.05 |
| 6,283,550 | B1 | * | 9/2001 | Vialatte et al. | 297/335 |
| 6,314,614 | B1 | | 11/2001 | Kuehl | |
| 6,349,449 | B1 | | 2/2002 | Kuehl | |
| 6,393,624 | B1 | | 5/2002 | Iwashita | |
| 6,427,287 | B1 | | 8/2002 | Brueckner et al. | |
| 6,477,738 | B1 | | 11/2002 | Kremer et al. | |
| 6,523,900 | B1 | * | 2/2003 | Conner et al. | 297/332 |
| 6,698,834 | B2 | * | 3/2004 | Olarte | 297/335 |
| 7,032,272 | B2 | * | 4/2006 | Haenlein | 16/366 |
| 7,100,983 | B1 | * | 9/2006 | Gant | 297/314 |
| 7,108,447 | B2 | * | 9/2006 | Akkala et al. | 404/25 |
| 8,020,254 | B2 | * | 9/2011 | Lin | 16/334 |
| 2002/0167789 | A1 | * | 11/2002 | Novin et al. | 361/681 |
| 2003/0090136 | A1 | * | 5/2003 | Olarte | 297/335 |
| 2004/0084943 | A1 | * | 5/2004 | Fisher | 297/335 |
| 2004/0100134 | A1 | | 5/2004 | Plant et al. | |
| 2005/0017558 | A1 | * | 1/2005 | Fewchuk | 297/331 |
| 2008/0203790 | A1 | * | 8/2008 | Olarte | 297/218.1 |
| 2009/0139054 | A1 | * | 6/2009 | Burnley | 16/224 |
| 2010/0180399 | A1 | | 7/2010 | Patzer et al. | |
| 2012/0261971 | A1 | * | 10/2012 | Olarte | 297/440.1 |
| 2013/0082500 | A1 | * | 4/2013 | Line et al. | 297/332 |
| 2014/0165331 | A1 | * | 6/2014 | Kang et al. | 16/224 |
| 2014/0283337 | A1 | * | 9/2014 | Triebold et al. | 16/224 |

OTHER PUBLICATIONS

Australian Government Patent Examination Report No. 1 Application No. 2012304735 Date of Issue Jun. 18, 2015 pp. 6.

* cited by examiner

HINGE MECHANISM WITH NON-CYLINDRICAL PIN

CROSS-REFERENCE TO RELATED APPLICATIONS

The present application claims the benefit under 35 U.S.C. §119(e) of the U.S. Provisional Patent Application Ser. No. 61/531,476, filed on Sep. 6, 2011, the content of which is incorporated herein by reference.

FIELD OF THE INVENTION

The invention relates to seating systems, and more specifically to a hinge mechanism with a non-cylindrical pin capable of providing adjustment and alignment of a seat and accommodating different seating styles.

BACKGROUND OF THE INVENTION

In many instances it is desirable for seating or a row of seating to allow for each individual seat bottom to be rotated upwards by means of a rotatable hinge mechanism. This allows more space and visibility for cleaning under and around the seat. In some instances, when the seat is located outdoors, the seat bottom is vertically oriented so that the accumulation of elements, such as water, snow and dirt, is hindered while the seat is not occupied or in use.

In addition, seating arrangements in an auditorium or stadium can vary in style and dimension. The widths of seats in one venue may differ from the seat widths of another venue. Within one auditorium, seating can comprise both linear and curved sections of seating. As such, the leg supports for said seats are either positioned in a parallel or non-parallel orientation. The curvature of a curved seating arrangement can also vary in degree. Due to the above limitations, hinge mechanisms are designed to accommodate a specific design or style of seating and thus are not universal. Further, after wear and tear, seats often require maintenance, such as adjustment and alignment of seat bottoms relative to the leg supports, and/or replacement of seat bottoms.

Various seating systems exist where the seats each have hinges for raising and lowering the seat bottom. For example, U.S. Pat. No. 5,601,335 to Woods et al. discloses a seat mounting assembly which allows the seat to be removed and replaced. The assembly includes a hexagonal shaft attached to a frame, and a bushing and a stop member mounted at an opposite end of the shaft. To pivotably join the seat to the frame, the seat is positioned rearwardly towards the assembly until the bushing and stop member engage, respectively, a socket and a stop pin mounted within the seat.

U.S. Pat. No. 3,813,149 to Lawrence, III et al. discloses a hinge device substantially enclosed for protection against weather damage. The hinge includes an enclosure forming a portion of the seat, wherein a spherical bearing member mounted along a circular shaft and a spherical race member supported by the bearing member produce the needed pivoting motion. As the hinge device is rotated, the shaft remains fixed to a frame while the spherical race member attached to the seat pivots around the bearing member. Although the hinge provides for pivotal mounting, it is not adapted for implementation in different seating styles (e.g. curved seating, straight seating).

U.S. Pat. No. 3,727,975 to Anderson discloses a hinge mechanism enclosed within a seat frame bracket and a registry hub. Inside the registry hub, a bushing mates with the semispherical head of a pivot bolt while a threaded shank of the pivot bolt is connected to the seat frame bracket. Upon rotation of the seat frame bracket, the semispherical head pivots freely within the bushing. In one embodiment, a conical relief chamber near an open end of the bushing allows for off-axis positioning and movement of the bolt to offset any misalignments of the seat relative to side support members. However, the hinge is not capable of accommodating different seat sizes and widths.

U.S. Pat. No. 2,000,172 to Hanson discloses a hinge having, among other components, a tubular shaft rotatably attached to a support member at one end and attached to a seat bracket at an opposing end. The seat bracket is provided with a laterally projecting U-shaped arm which embraces the shaft and is laterally adjustably secured by a bolt passing through the shaft and the U-shaped arm. Hanson, however, discloses a complex device comprising multiple mechanical components, including screws, bolts and rivets, and does not provide for easy adjustment or removal of the seat.

U.S. Patent Application Publication 2004/0100134 A1 to Plant et al. discloses a hinge mechanism having a seat boss on the side of a seat inserted into a stanchion boss. A bush is then placed within the seat boss to provide spacing between the seat boss and the stanchion boss. By varying the length of the bush, a user can adjust the width required between each seat. However, once the seat is installed, the hinge mechanism does not allow for removal or replacement of the seat bottom.

Thus, while various hinge mechanisms exist, there is a need in the art for an improved hinge. It is desirable for the hinge mechanism to provide for adjustment and alignment of the seat bottom while still supporting the weight of a seat occupant. Further, the hinge mechanism should accommodate seats of different widths without requiring the leg frames to be moved or replaced. It is also desired to provide a hinge that is readily adaptable and adjustable for seats having different placements.

It is also desirable for the hinge mechanism to accommodate both linear seating wherein the leg supports are mounted in parallel and curved seating wherein the leg supports are mounted in non-parallel orientation. As the curvature of seating in one auditorium or stadium may differ, a suitable mechanism should provide a range of adjustability in the angle of the hinge.

It is also desired to provide a seating hinge mechanism that allows for easy removal and replacement of a seat bottom.

SUMMARY OF THE INVENTION

An object of the present invention is to remedy the problem of hinges lacking the capability for easy adjustment and alignment of seats with respect to leg supports disposed in parallel or non-parallel orientation. The present invention accommodates a seat with a hinge mechanism that allows for adjustment and alignment of a seat bottom while still providing support for an occupant's weight. The hinge mechanism provides for such adjustment without regard to the orientation of the leg supports.

It is a further object of the present invention to provide a seating hinge with a telescoping connection to allow for different and varying seat widths and placements.

It is another object of the present invention to provide a hinge that can accommodate seat bottoms having different widths without requiring the leg frames to be moved or replaced.

It is another object of the present invention to provide a hinge that can accommodate an auditorium having straight and/or curved sections of seating.

It is yet another object of the present invention to provide a hinge that allows a suitable range of adjustability to accommodate straight or arcuate seating having varying degrees of curvature.

It is still another object of the present invention to provide a simple hinge that is adapted to withstand weather and deteriorating elements present in many outdoor locations, such as dirt, dust and debris.

These and other objects are achieved by providing a hinge mechanism for a seat assembly, wherein the hinge includes a pin having a race member at its distal end and a shaft at its proximal end, a bracket having a socket, the pin inserted into the bracket so that the race member mates with the socket, and a seat having an aperture disposed on a side of the seat. The aperture is sized to accommodate the shaft portion of the pin such that the shaft is inserted into the aperture of the seat. With the shaft and aperture coupled to each other, the pin is rotatable to allow the seat to be placed in a vertical or horizontal position.

In some embodiments, the shaft is in telescopic connection with the aperture in the seat. In some embodiments, the telescopic connection forms a fitted arrangement while still providing tolerance for the adjustment and alignment of the seat. Furthermore, the telescopic connection is adapted to withstand the weight of a seat occupant.

Other objectives of the invention are achieved by providing a hinge mechanism including an elongated pin having a curved race member at its distal end and a shaft at its proximal end, and an enclosure having a latch and a socket, wherein the socket receives the race member to form a ball joint, and wherein the shaft is inserted into a tubular seat brace creating a telescopic connection. The hinge mechanism with its telescopic connection places the surfaces of the shaft in slideable contact with the inner walls of the seat brace, forming a fitted arrangement. In one embodiment, the fitted arrangement produces a snug fit. In another embodiment, the telescopic connection provides tolerance for adjusting the alignment of the seat notwithstanding the fitted arrangement.

Additional objectives are achieved by providing a hinge mechanism that has a pin, a race member disposed at a distal end of the pin and a shaft disposed at a proximal end of the pin, a bracket having a socket which mates with the race member when the pin is inserted into the bracket, and at least one leg support.

In some embodiments, the hinge mechanism further comprises the leg support having a backplate, wherein the backplate attaches to the bracket. The attachment between the backplate and the bracket creates a seal which prevents exposure of the pin, race member, and socket to weather and/or deteriorating elements.

In other embodiments, the backplate is in contact with the distal end of the pin, the contact pressing the race member into the socket and supporting continuous mating between the race member and socket.

Other objectives of the invention are achieved by providing a hinge mechanism including a pin having a curved race member at its distal end and a shaft at its proximal end, a bracket having a socket, the socket mating with the race member when the pin is inserted into the bracket, the shaft being removably coupled with a seat brace of a set bottom, and a hinge arm attached to the pin on the distal end. When the pin is combined with the bracket, the arm is disposed entirely within the bracket. Moreover, the arm can comprise any planar shape, such as a bar.

In some embodiments, the bracket further includes at least one stop defining the extent the pin rotates within the socket. For instance, as the seat bottom rotates, the pin and the arm rotate in corresponding motion until the arm contacts the stop at a desired end of rotation. When contact is made between the arm and stop, the pin and subsequently the seat bottom are prevented from rotating further. In one embodiment, the stop provides damping, regulating the rotational motion of the pin and arm as well as silencing any sounds created by these components during rotation.

In some embodiments, the shape of the pin is selected from the group consisting of triangle, square, rectangle and pentagonal.

Further objectives are achieved by providing a hinge mechanism for a seat assembly, including a pin having a race member at its distal end and a shaft at its proximal end, a bracket having a latch and a socket, the pin inserted into the bracket so that the race member mates with the socket, and a seat having a seat brace, the seat brace having an aperture, the aperture sized to accommodate the shaft, wherein the shaft is inserted into the aperture, and the pin is rotatable to allow the seat bottom to be placed in a vertical or horizontal position.

In some embodiments, the shaft is in telescopic contact with the aperture in the seat brace. In further embodiments, the telescopic contact forms a fitted arrangement while still providing tolerance for the adjustment and alignment of the seat bottom.

In some embodiments, the hinge mechanism also has a backplate, the backplate attaching to a first side of the bracket, wherein the attachment creates a seal therebetween.

In some embodiments, the hinge mechanism further includes a faceplate attached to a second side of the bracket, the second side of the bracket opposing the first side, wherein the attachment creates a seal between the bracket and the faceplate. With the latch, backplate, and faceplate, the bracket becomes a completely sealed enclosure which prevents any exposure to weather or deteriorating elements.

In some embodiments, the hinge mechanism includes an arm attached to the pin on the distal end and a plurality of stops disposed within the bracket, wherein each of the plurality of stops defines a desired end of rotation. When the seat bottom rotates in a given direction, the pin similarly rotates in the socket and the arm rotates with the pin. When the arm contacts one of the stops, the arm and consequently the pin and seat bottom are prevented from rotating any further in a given direction.

Additional objectives of the invention are achieved by providing a hinge mechanism for a seat assembly, said hinge mechanism includes a pin having a curved race member at a distal end of the pin and a shaft at a proximal end of the pin, an arm attached to the distal end, a bracket having a socket, the pin inserted into the bracket so that the race member mates with the socket and the arm is disposed within the bracket, a seat having a seat brace, wherein the seat brace has an aperture sized to accommodate the shaft, the shaft inserted into the aperture such that a telescopic connection is created, the bracket attached to a backplate, wherein the backplate is in contact with the distal end, the contact pressing the race member into the socket and creating a snug fit therebetween, the backplate attached to a leg support, and the pin rotatable to allow the seat to be placed in a vertical or horizontal position. In some embodiments, the backplate and leg support are integrated together and form a single component.

Other objectives of the invention are achieved by providing a hinge mechanism for a seat assembly, said hinge mechanism includes a pin having a curved race member at a distal end of the pin and a shaft at a proximal end of the pin, at least two arms attached to the distal end, and a bracket having a socket, wherein the pin is adapted to be inserted into the bracket so that the race member mates with the socket and forms a ball joint therewith. The at least two arms extend radially outward from the distal end. In some embodiments, the arms extend in opposite directions from the distal end. Further, the bracket comprises an upper housing releasably attached to a lower housing, said upper housing is adapted to provide an opening for said bracket to receive the distal end of the pin when detached from said lower housing. When the lower housing and upper housing of the bracket are attached to each other, they form a cylindrical shape with a circular cross-section. The shaft is further adapted to be inserted into a tubular seat brace of a seat bottom which creates a telescopic connection.

In some embodiments, the bracket includes a plurality of stops defining the extent the pin rotates within the socket. For instance, as the seat bottom rotates, the pin and the arms rotate in corresponding motion until one of the arms contacts one stop at a desired end of rotation. When contact is made between the arm and stop, the pin and subsequently the seat bottom are prevented from rotating further. In other embodiments, each of the arms contacts a stop at a desired end of rotation. With multiple arms contacting multiple stops at a desired end of rotation, increased control over the rotation of the pin disposed within the socket is provided.

Further provided is a row of adjacent seats, each seat having leg supports, a seat bottom, and one or more hinge mechanisms attached to the leg supports such that a telescopic connection is created between the leg supports and the seat bottom. In one embodiment, the row of adjacent seats is straight, wherein each hinge mechanism provides for adjustment and alignment of the seat bottom relative to the leg supports disposed in parallel orientation. In another embodiment, the row of adjacent seats is arcuate, wherein each hinge mechanism provides adjustment and alignment of the seat bottom relative to the leg supports disposed in non-parallel orientation.

The hinge mechanism according to the present invention improves the adjustability of a seat bottom relative to a leg support without requiring disassembly of the seat and avoids the disadvantages/inconveniences associated with prior art seat hinges. It also accommodates different seat widths and different seating styles (e.g., straight seating, arcuate seating) while supporting the weight of a seat occupant. Further, the hinge mechanism according to the present invention allows for easy removal and replacement of the seat bottom.

Other objects of the invention and its particular features and advantages will become more apparent from consideration of the following drawings and accompanying detailed description.

DETAILED DESCRIPTION OF THE INVENTION

Figure 1:
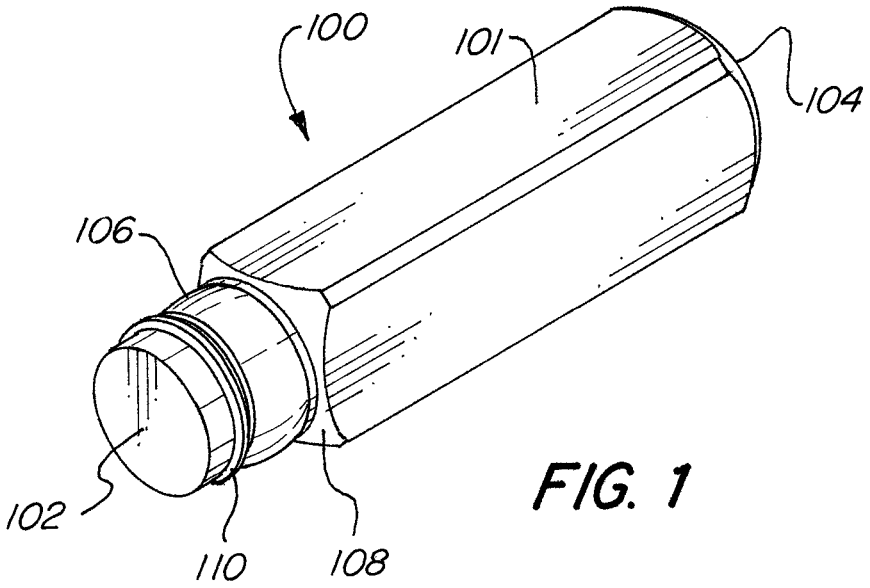
FIG. 1 is a perspective view of a pin according to an embodiment of the present invention.

Referring to the figures in detail and first to FIG. 1, there is shown an exemplary embodiment of a pin 100, which is a component of the hinge mechanism. FIG. 1 illustrates pin 100 having a shaft 101, a distal end 102 and a proximal end 104. Distal end 102 includes a race member 106 having a smooth curved surface. In one embodiment, race member 106 comprises a sphere having opposite sides parallelly truncated. Shaft 101 has a noncircular cross-section, which in some embodiments may be triangular, square, rectangular, pentagonal, or other polygonal shape. Shaft 101 has a contour surface 108, which in some embodiments may be radiused or rounded in the direction of proximal end 104. In one embodiment, pin 100 has a flange 110 disposed between race member 106 and distal end 102. Flange 110 may be rounded or shaped in the direction of distal end 102, such that the radius of flange 110 gradually increases towards distal end 102. It is understood that where appropriate, angled surfaces may be rounded or chamfered without departing from the spirit of the present invention.

Figure 2A:
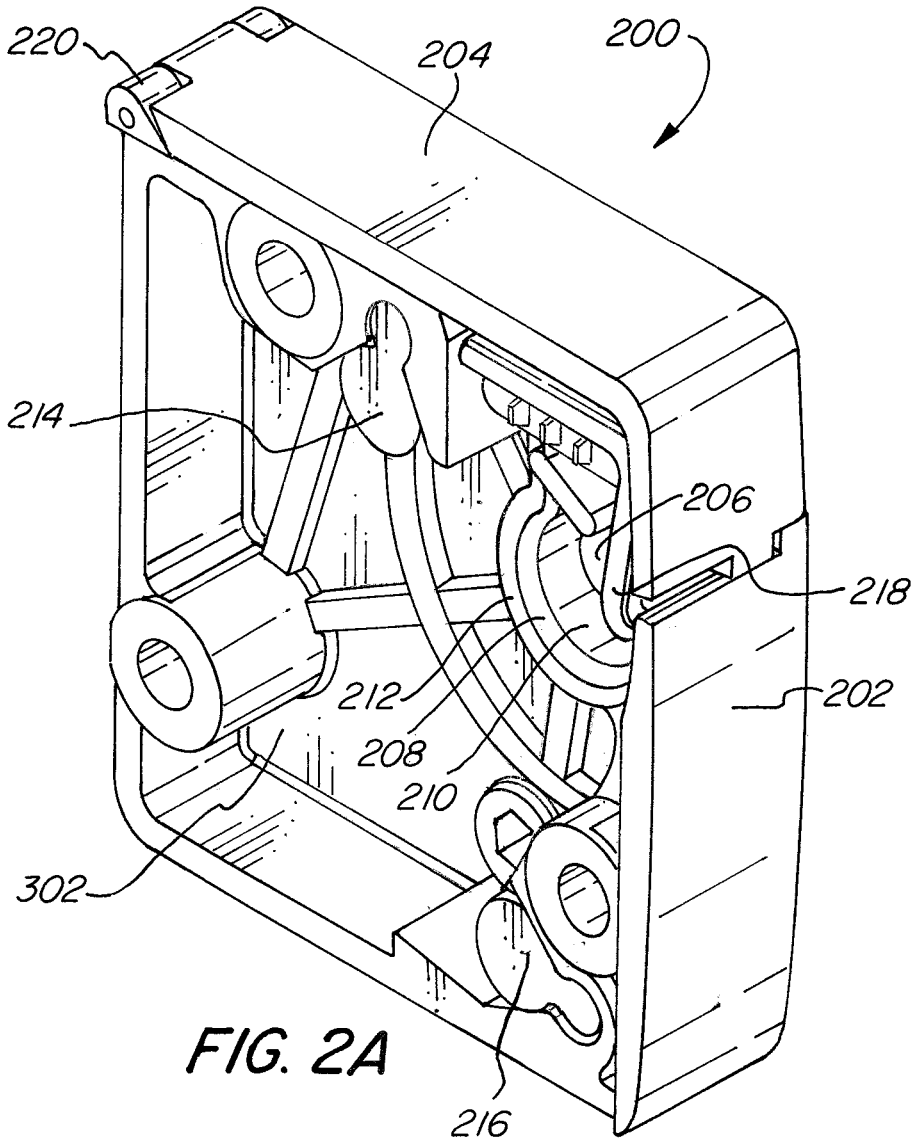
FIG. 2A is a perspective view of a bracket assembly according to an embodiment of the present invention in a closed configuration.
Figure 2B:
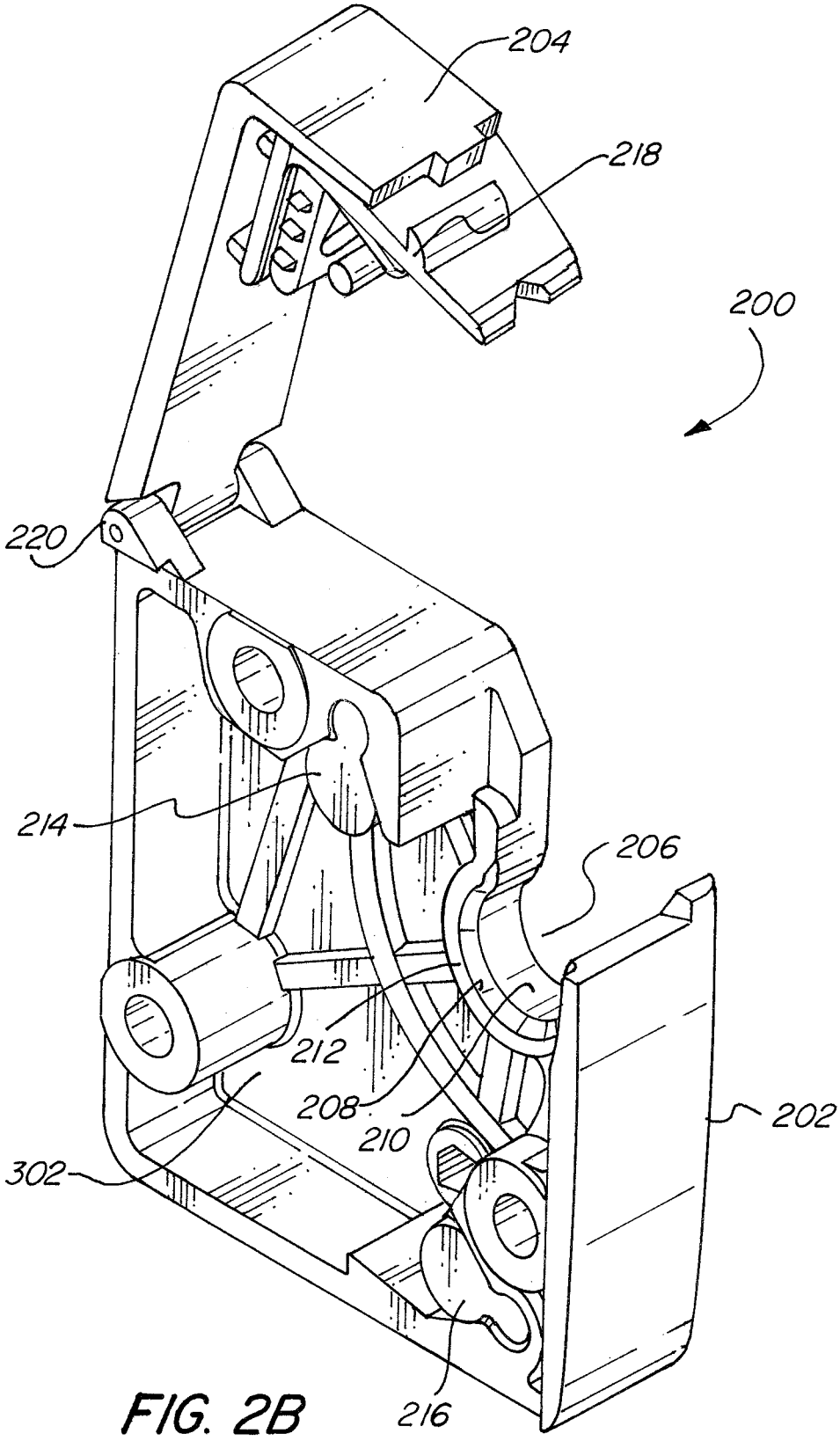
FIG. 2B is a perspective view of the bracket assembly of FIG. 2A in an open configuration.

FIGS. 2A-2B illustrate a bracket 200 according to one embodiment of the hinge mechanism. In some embodiments, bracket 200 is made of a metallic material. In other embodiments, bracket 200 is made of plastic. Bracket 200 includes a housing 202, latch 204, and socket 206. Socket 206 includes a first bearing surface 208, a second bearing surface 210, and a third bearing surface 212. A faceplate 302 is permanently attached to one side of housing 202, which creates a seal between the two elements. As illustrated in FIG. 2A, the faceplate 302 comprises socket 206. A backplate 306 (FIG. 3) is removably attached to housing 202 on a side opposite faceplate 302. With the ability to detach and reattach backplate 306 to housing 202, easy access to the interior of housing 202 is provided. Similar to faceplate 302, backplate 306 creates a seal with housing 202 to complete an enclosure of bracket 200.

As shown in FIG. 2A, latch 204 is disposed in a closed position and secured with a fastener 218. While in the closed position, latch 204 contacts housing 202 and creates a seal therewith. In addition, when latch 204 is in the closed position, it forms a portion of socket 206 by completing the circular contour of first bearing surface 208, second bearing surface 210, and third bearing surface 212. Alternatively, latch 204 can be disposed in an open position by releasing fastener 218 and rotating latch 204 about pivot 220, as shown in FIG. 2B. The open position provides access to socket 206 for insertion of pin 100 and provides access to the interior of bracket 200 for maintenance (e.g., adjustment and/or alignment of pin 100).

Bracket 200 also comprises stops 214, 216, which serve as dampers or shock absorbers and regulate the rotational motion of pin 100 when it mates with socket 206. Stops 214, 216 can be made of silicone, rubber or any other suitable material exhibiting damping characteristics. Stops 214, 216 are also adapted to be removably attached to the interior of bracket 200. Accordingly, stops 214, 216 can be easily removed from bracket 200 for repair or replacement. Further details regarding the functional aspects of stops 214, 216 are discussed below.

Figure 3:
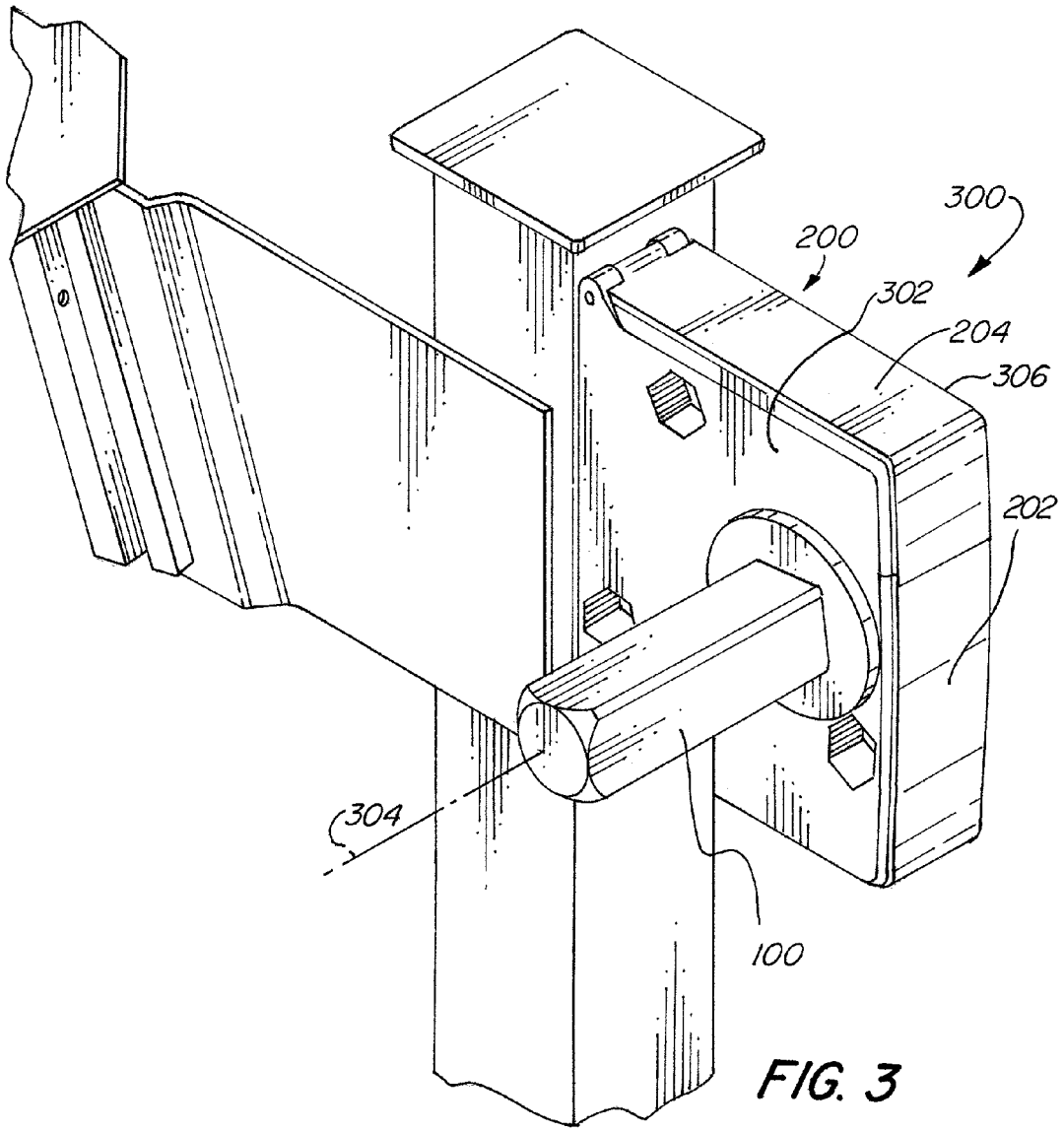
FIG. 3 is a perspective view of a hinge assembly comprising the pin of FIG. 1 and the bracket of FIG. 2A according to an embodiment of the present invention.

FIG. 3 illustrates a hinge assembly 300 comprising bracket 200 and pin 100, according to some embodiments of the present invention. Pin 100 can be assembled with bracket 200 by opening latch 204, placing race member 106 (FIG. 1) within socket 206 (FIGS. 2A-2B), and then closing latch 204 to secure pin 100. When pin 100 and bracket 200 are assembled together, race member 106 mates with first and second bearing surfaces 208, 210 while flange 110 contacts third bearing surface 212. Furthermore, with hinge assembly 300, contour surface 108 of pin 100 is in contact with faceplate 302. In some embodiments, backplate 306 is in contact with the distal end 102, exerting pressure thereon to ensure that there is constant mating contact between race member 106 and first and second bearing surfaces 208, 210. In another embodiment, the contours of first and second bearing surfaces 208, 210 match the shape of race member 106. Therefore, the bearing surfaces and race member are adapted to form a complementary fit with each other. This complementary fit still provides tolerance for adjusting and/or aligning the pin 100 with the bracket assembly 200. The geometric characteristics of bearing surfaces 208, 210 and race member 106 are such that pin 100 is held securely within bracket 200, but is free to rotate axially. Furthermore, the geometries of all bearing components of pin 100 (race member 106, contour surface 108, flange 110) and bracket 200 (first, second and third bearing surfaces 208, 210, 212) are such that the axis 304 of pin 100 can deviate from perpendicular to socket 206 and faceplate 302 while leaving the pin 100 free to rotate. In some embodiments, this deviation may be up to 5 degrees from perpendicular.

Figure 4:
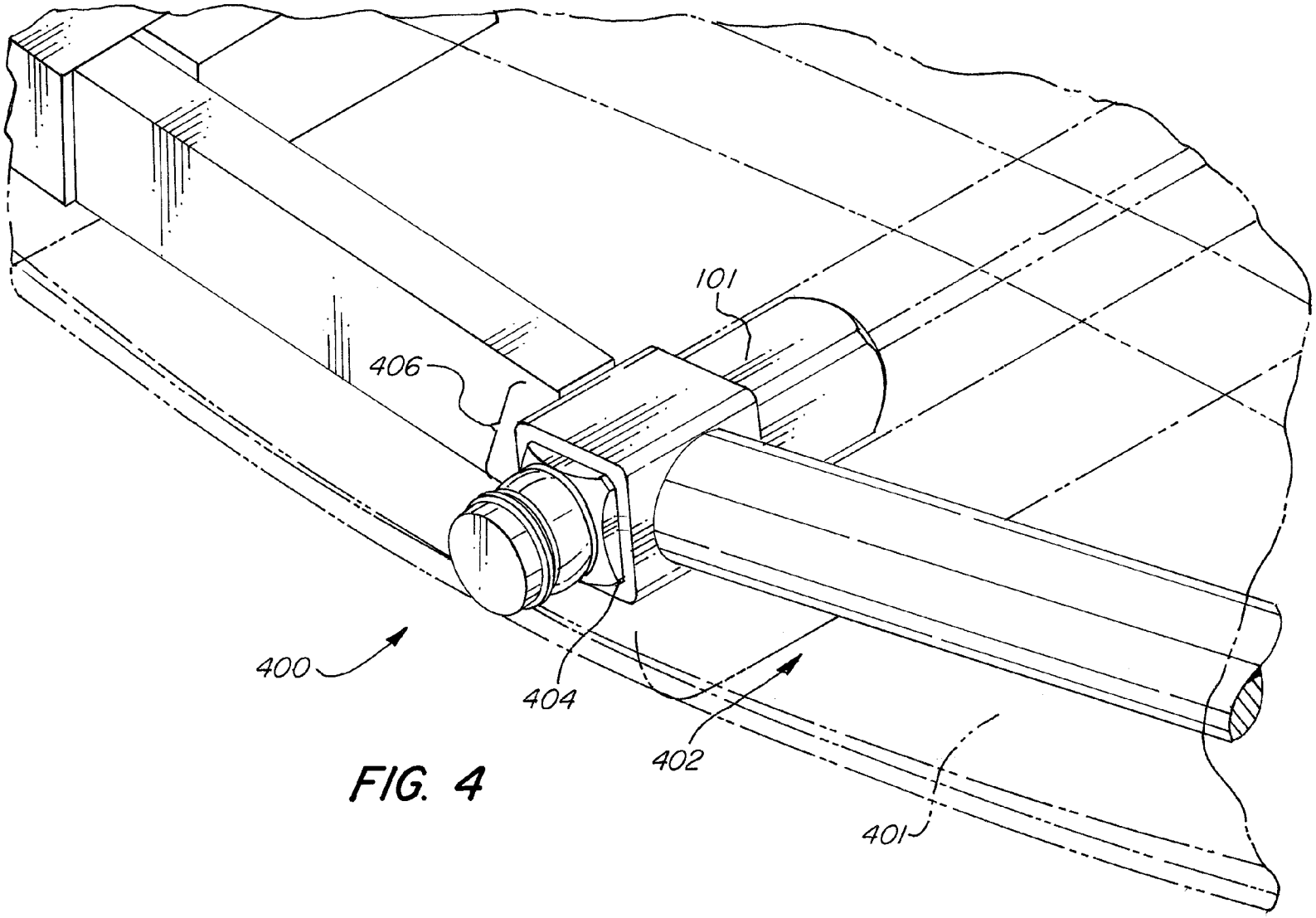
FIG. 4 is a perspective view of a partial seat assembly according to an embodiment of the present invention.

FIG. 4 illustrates a partial seat assembly 400, wherein pin 100 is incorporated into seat bottom 401. Seat bottom 401 can be made of any material suitable for providing cushion and support to a seat occupant. Seat bottom 401 includes a side 402 which has a seat brace 404 disposed therein. Seat brace 404 comprises an aperture that is adapted in shape and size to accommodate shaft 101 of pin 100. When shaft 101 is inserted into seat brace 404, via lateral movement, the two components form a telescopic connection 406. The dimensions of telescopic connection 406 are such that shaft 101 maintains a fitted arrangement within seat brace 404 while still providing tolerance for adjustment and alignment. Further, the telescopic connection 406 is adapted to support the weight of the seat occupant. The pin 100 may comprise a thin layer of thermo plastic film covering shaft 101 to reduce noise that may be produced from contact between shaft 101 and seat brace 404. In addition, the thermo plastic film also provides ease in inserting and removing shaft 101 of pin 100 relative to seat brace 404.

In further detail, the flat surfaces of shaft 101 contact flat surfaces of an interior of seat brace 404. With these flat surfaces, shaft 101 helps distribute the load (i.e., weight of seat occupant) imposed on the pin 100 and further hinge assembly 300 (FIG. 3). In addition, these flat surfaces help to stop the rotation of seat bottom 401 equally in both directions (i.e. clockwise, counterclockwise).

Figure 5:
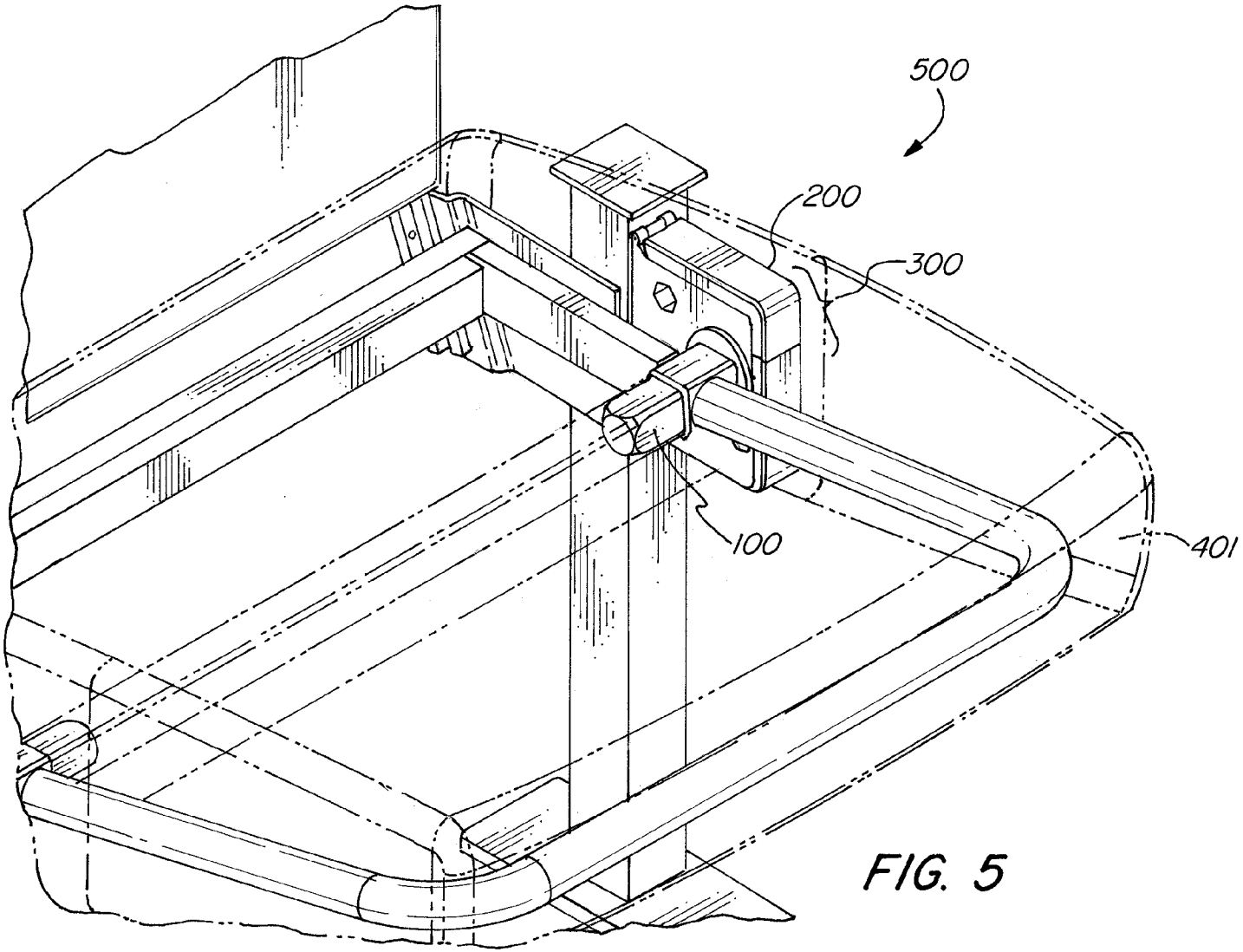
FIG. 5 is a detail view of a full seat assembly according to an embodiment of the present invention.

FIG. 5 illustrates a detail view of a full seat assembly 500 according to an embodiment of the invention. Pin 100 is assembled with bracket assembly 200 and seat bottom 401. Seat bottom 401 is shown in a horizontal position for seating. Stop 214 (FIG. 2A) prevents the rotation of seat bottom 401 past the horizontal position. In one embodiment, stop 214 is integrated in bracket 200, as shown in FIGS. 2A-2B. In another embodiment, stop 214 is integrated into seat bottom 401 of seat assembly 500. In yet another embodiment, stop 214 is integrated in both bracket 200 and seat bottom 401 or in another component. When seat bottom 401 is not being used, it may rotate to a vertical position to prevent accumulation of precipitation or debris, and to facilitate ease of cleaning. Stop 216 (FIG. 2A) prevents rotation of seat bottom 401 past the vertical position. Similar to stop 214, stop 216 can be integrated in bracket 200, seat bottom 401, or both bracket 200 and seat bottom 401. Given the above configuration, stops 214, 216 define the extent seat bottom 401 can rotate in either direction (e.g. clockwise or counter-clockwise). Stops 214, 216 are also adapted to regulate the speed at which pin 100—and thus seat bottom 401—rotates. Stops 214, 216 have damping characteristics to prevent any recoil, backlash, or vibration of seat bottom 401 when it is disposed in either horizontal or vertical position. The damping characteristics of stops 214, 216 also help reduce any noise created by pin 100 and/or bracket 200 when seat bottom 401 rotates from one position to the other.

In some embodiments of the present invention, seat assembly 500 incorporates bushings within some or all of its component parts for additional noise damping. Like stops 214, 216, these bushings may be made of silicone, urethane, plastic, or any other material demonstrating suitable damping characteristics.

Figure 6:
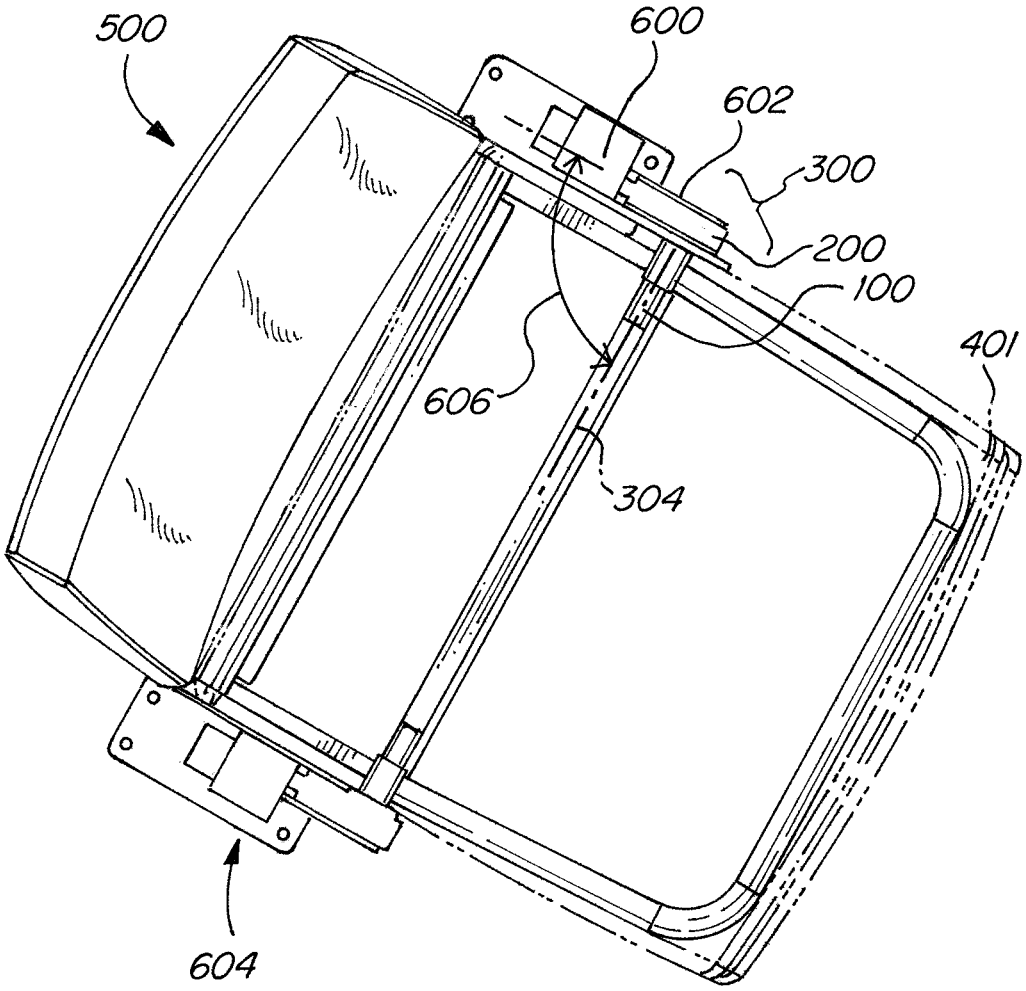
FIG. 6 is an overhead view of a full seat assembly according to an embodiment of the present invention.

FIG. 6 illustrates an overhead view of full seat assembly 500 according to an embodiment of the hinge mechanism. Pin 100 is assembled with bracket 200 and seat bottom 401. Seat bottom 401 is shown in a horizontal position for seating. A leg support 600 is provided, which includes or is attached to a backplate 602, which is substantially identical to the backplate 306 described above. Backplate 602 serves as an attachment to bracket 200, and is a component of hinge assembly 300. An axis 304, which corresponds to the axis of pin 100 when in telescopic connection with seat brace 404 (FIG. 4), forms an angle 606 with leg support 600. In one embodiment of the invention, angle 606 is 90 degrees, as shown in FIG. 6. A similar arrangement of components 604 comprising pin 100, bracket assembly 200, leg support 600, and backplate 602 is provided on the opposite side of seat bottom 401. Consequently, two arrangement of components 604 are disposed on both sides of seat bottom 401. With the above configuration (i.e., angle 606 being 90 degrees), full seat assembly 500 is suitable for seats placed in a straight row of seating, wherein each seat faces a common direction and the leg supports 600 of each seat are placed substantially parallel to each other. With seat bottom 401 assembled with the hinge mechanism, that is when shaft of pin 100 is telescopically connected with seat brace 404 (FIG. 4), the shaft of pin 100 extends perpendicularly with socket 206 (FIG. 2A).

Figure 7:
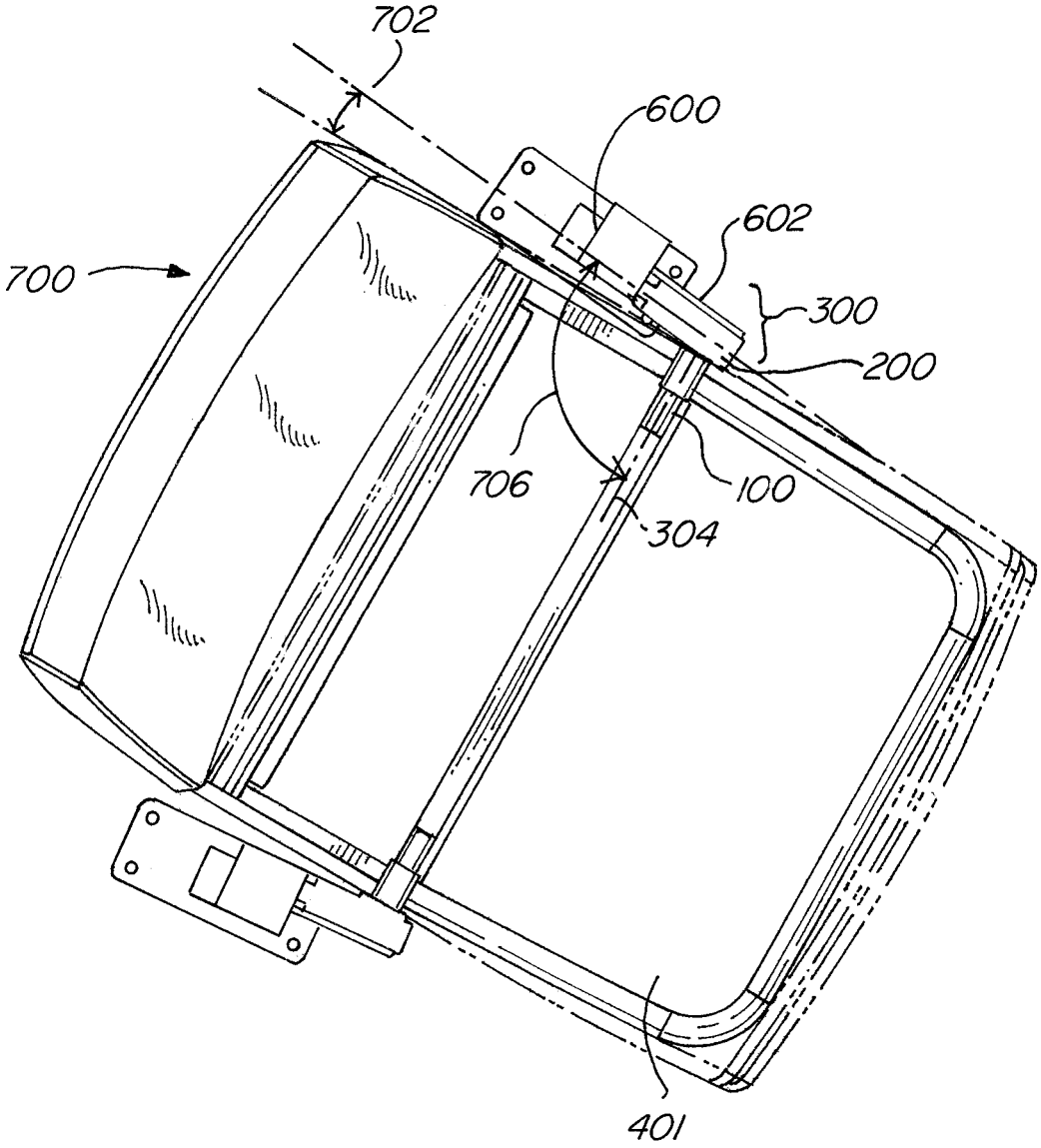
FIG. 7 is an overhead view of a full seat assembly according to an embodiment of the present invention.

FIG. 7 illustrates an overhead view of a full seat assembly 700 according to an embodiment of the hinge mechanism. Full seat assembly 700 is substantially identical to seat assembly 500 (FIGS. 5 and 6), except that an angle 702 between leg support 600 and side 402 (FIG. 4) of seat bottom 401 is greater than or less than zero degrees. In some embodiments, angle 702 may be ±5 degrees. As a result, an angle 706 between axis 304 and bracket 200 deviates from perpendicular (90 degrees). In some embodiments, angle 706 may be between 85 and 95 degrees. Despite angle 706 deviating from 90 degrees, pin 100 remains free to rotate within hinge assembly 300. As shown in FIG. 7, angle 706 is greater than 90 degrees. With such a configuration, full seat assembly 700 can be used for seats placed in a curved row of seating, and more specifically a concave row of seats. If angle 706 is less than 90 degrees, full seat assembly 700 can be used for seats placed in a convex row of seating. These two arcuate seating configurations are characterized with leg supports 600 positioned in non-parallel fashion. Further, when the shaft of pin 100 is in telescopic connection 406 with seat brace 404 (FIG. 4), the shaft of pin 100 extends off perpendicular from the socket 206, as shown in FIG. 7. In some embodiments, the shaft can be disposed such that it extends up to 5 degrees off a perpendicular to the socket 206. Therefore, full seat assembly 700 can accommodate different styles of seating.

Figure 8:
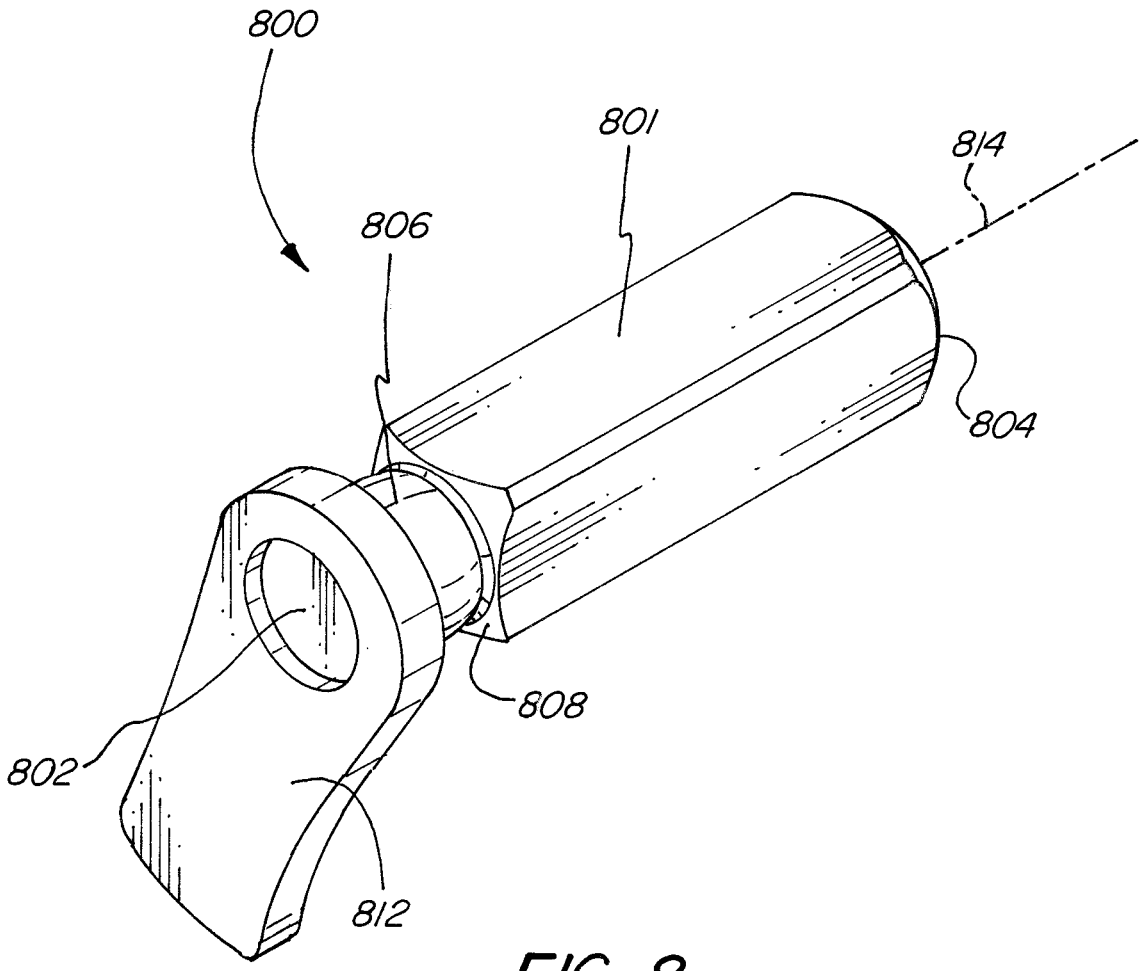
FIG. 8 is a perspective view of a pin assembly according to an embodiment of the present invention.

FIG. 8 illustrates a pin assembly 800 according to another embodiment of the present invention. Here, pin 800 is substantially similar to pin 100 (FIG. 1) in that pin 800 comprises a shaft 801, a distal end 802 and a proximal end 804, wherein distal end 802 has a race member 806. Pin 800 also includes an arm 812 attached at distal end 802 and adjacent to a flange (see 110 in FIG. 1) that is disposed on a side of race member 806 opposite contour surface 808. The shaft 801 and arm 812 are connected such that they form a universal joint, or a similar joint. In one embodiment, arm 812 is disposed perpendicularly with axis 814 of shaft 801. In other embodiments, arm 812 is disposed on distal end 802 at slightly off perpendicular with axis 814. Arm 812 may comprise any shape suitable for controlling the rotation of pin 800 when disposed within bracket 200 (FIG. 2A). In one embodiment, the shape of arm 812 resembles a bar.

Figure 9:
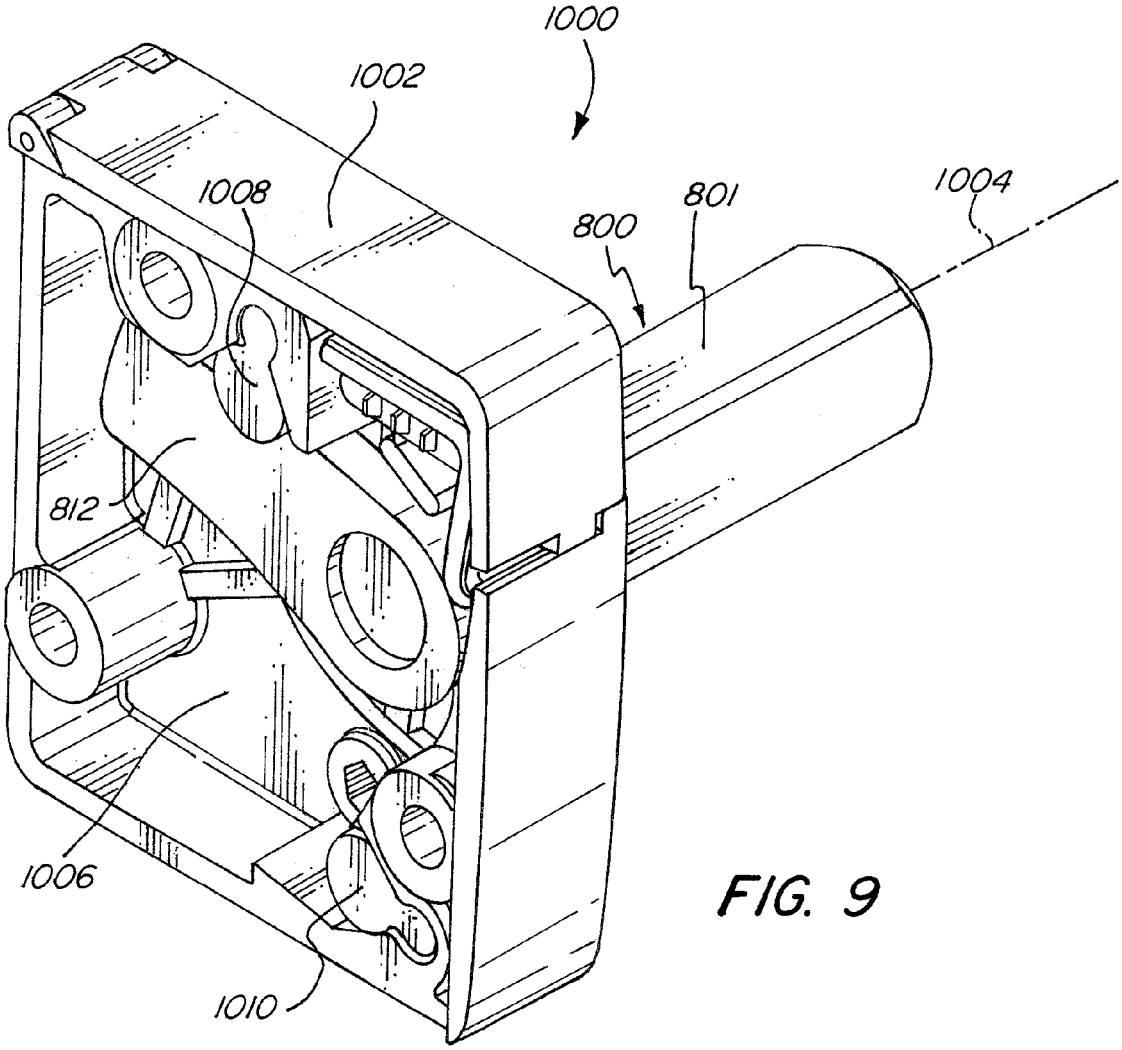
FIG. 9 is a perspective view of a hinge assembly comprising the pin of FIG. 8 and the bracket of FIG. 2A according to an embodiment of the present invention.
Figure 10:
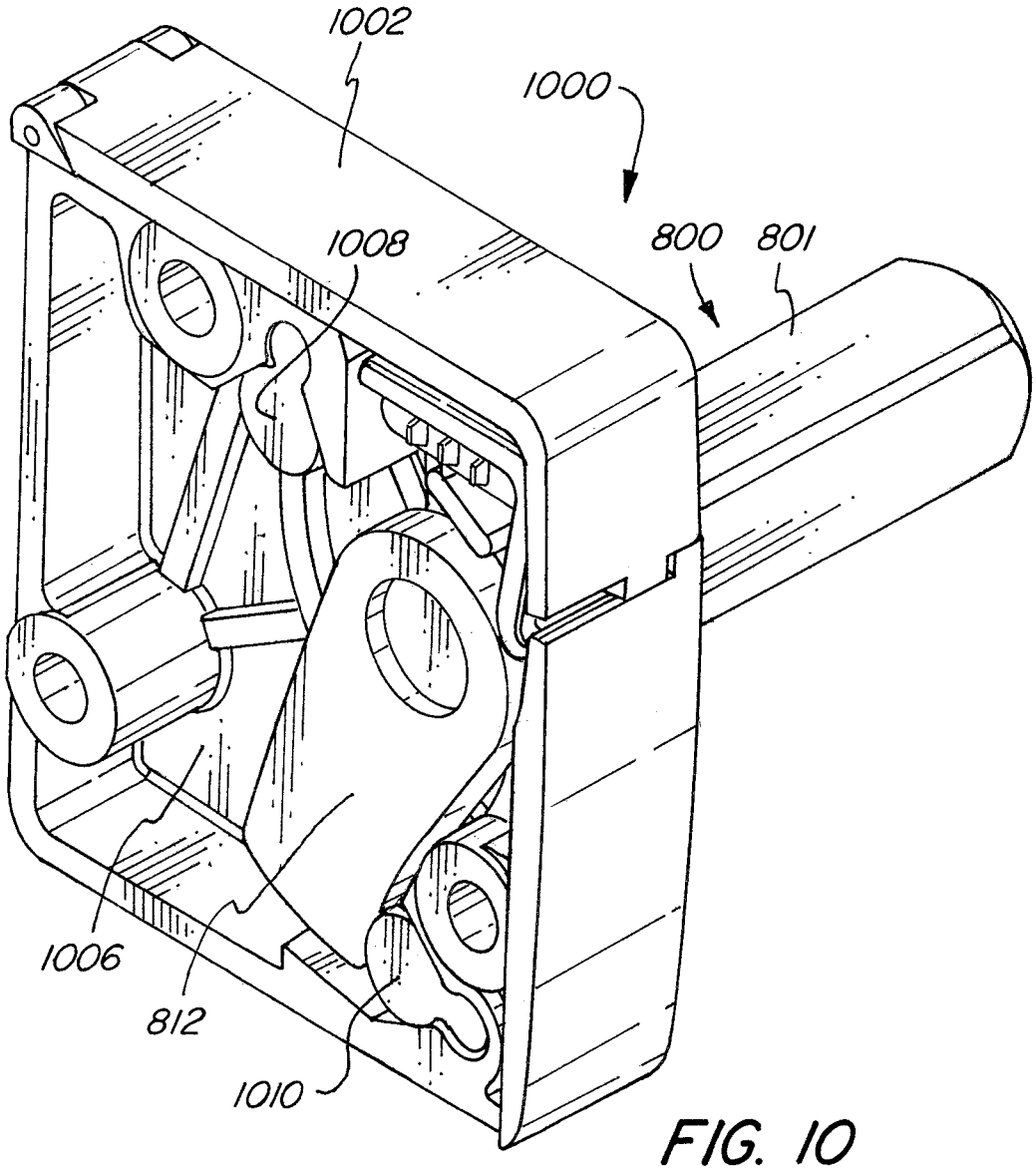
FIG. 10 is a perspective view of the hinge assembly of FIG. 9 according to an embodiment of the present invention.

FIGS. 9-10 illustrate a hinge assembly 1000 according to an embodiment of the invention. Hinge assembly 1000 includes bracket 1002, which is similar to bracket 200 (FIG. 2A). Pin 800 is inserted into bracket 1002 in a similar fashion to hinge assembly 300 (FIG. 3). Shaft 801 of pin 800 has an axis 1004 that is perpendicular to a faceplate 1006. However, pin 800 and its axis 1004 can deviate several degrees from perpendicular without creating any interference between bracket 1002 and pin 800 as it rotates. When pin 800 is inserted into bracket 1002, arm 812 is disposed within bracket 1002 such that arm 812 limits the rotation of pin 800 about axis 1004. In some embodiments, the total sweep of rotation of pin 800 and arm 812 is between 80 and 90 degrees. As shown in FIG. 9, pin 800 is at one extreme end of its rotation sweep, with arm 812 contacting stop 1008. Stop 1008 prevents arm 812 and subsequently pin 800 from rotating further in a clockwise direction. Conversely, as shown in FIG. 10, pin 800 is at the opposite extreme end of its rotation sweep, with arm 812 contacting stop 1010. Stop 1010 prevents arm 812 and subsequently pin 800 from rotating further in a counterclockwise direction. As contact is made with arm 812, stops 1008, 1010 also absorb the impact of arm 812 and eliminate any resulting recoil, backlash, or vibrations in pin 800. In addition, stops 1008, 1010 dampen any sound created by pin 800 when it rotates or comes to a complete stop at one extreme end of rotation. In one embodiment, stops 1008, 1010 are made of silicone. In other embodiments, stops 1008, 1010 are made of rubber or any suitable material for providing the above damping effects. Hinge assembly 1000 with axis 1004 perpendicular to bracket 1002 provides a configuration that can be implemented into full seat assembly 500 as shown in FIG. 6. As such, hinge assembly 1000 can be used in seats that are disposed in a straight row of seating.

Figure 11:
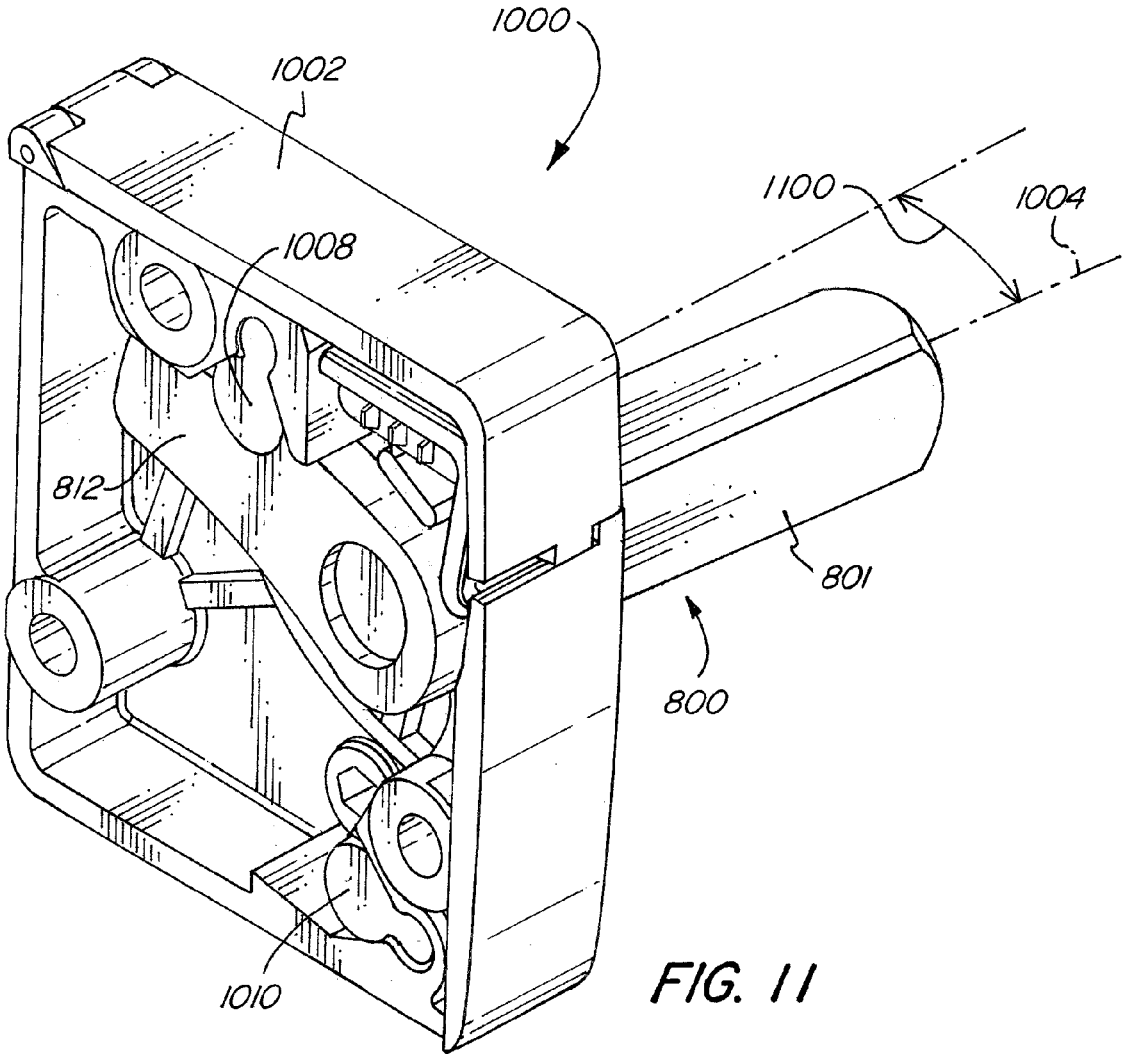
FIG. 11 is a perspective view of the hinge assembly of FIG. 9 according to an embodiment of the present invention.

FIG. 11 illustrates hinge assembly 1000 according to another embodiment of the invention. In particular, hinge assembly 1000 is configured such that axis 1004 of pin 800 is disposed at an angle 1100. In one embodiment, angle 1100 is 5 degrees. In another embodiment, hinge assembly 1000 may be configured such that axis 1004 is disposed at an angle 1100 that is −5 degrees. In yet other embodiments, hinge assembly 1000 may be configured such angle 1100 is between ±5 degrees. Regardless of the degree that angle 1100 possesses, there is no interference between pin 800, arm 812, and bracket assembly 1002. Pin 800 with shaft 801 and arm 812 remains free to rotate given any configuration that axis 1004 may have. With pin 800 disposed at angle 1100, hinge assembly 1000 can be implemented into full seat assembly 700 as shown in FIG. 7 and thus can accommodate seats that are situated in a curved row of seating.

Figure 12:
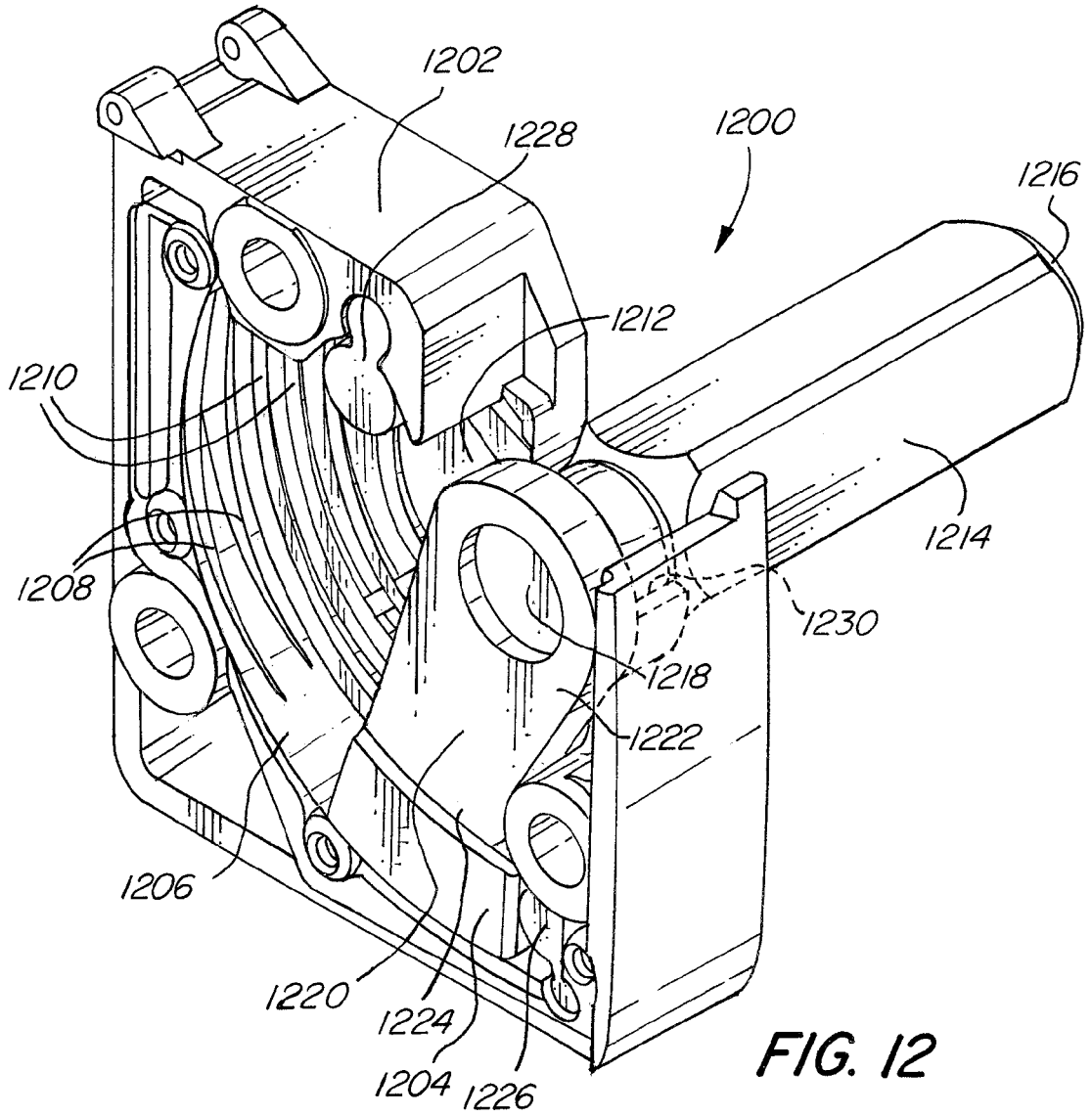
FIG. 12 is a perspective view of the hinge assembly of FIG. 9 according to an embodiment of the present invention.

FIG. 12 illustrates another exemplary embodiment of the hinge mechanism. Hinge mechanism 1200 comprises bracket 1202 and pin 1214. Bracket 1202 is similar to bracket 200 (FIG. 2A) but further includes a body 1204, a channel surface 1206, and one or more tracks 1210 disposed on the interior surface of faceplate 1212. As a note, the latch of bracket 1202 is hidden for ease in illustrating hinge mechanism 1200. Pin 1214 is also similar to pin 800 of FIG. 8. Pin 1214 has a proximal end 1216 and a distal end 1218, wherein a focal end 1222 of arm 1220 is attached to distal end 1218. The attachment between pin 1214 and arm 1220 allows for the two components to be rotationally coupled, but partially axially independent. Thus, a universal joint, or similar joint, is created when pin 1214 with arm 1220 is inserted into the socket 1230. Furthermore, when pin 1214 is assembled with bracket 1202, pin 1214 can be perpendicular or slightly off perpendicular with faceplate 1212 and socket 1230, without interfering with the rotation of arm 1220 and pin 1214.

When pin 1214 is inserted into the socket 1230, a body 1204 removably attaches to arm 1220 at a peripheral end 1224. With this configuration, body 1204 moves along a channel surface 1206 as pin 1214 and correspondingly arm 1220 rotate. Body 1204 further comprises one or more grooves adapted to receive and follow tracks 1210. The combination of tracks 1210 and the grooves help control the movement of body 1204 along channel surface 1206. The tracks 1210 and grooves of body 1204 also help to regulate the rotational motion of pin 1214. Specifically, once pin 1214 begins rotating, friction between the tracks 1210 and the grooves slows the movement of body 1204 and thus the rotational motion of arm 1220 and pin 1214. The tracks 1210 further provide noise damping to silence any sounds created by pin 1214 and any other components of hinge mechanism 1200 during rotation. Tracks 1210 can comprise silicone or any material suitable for achieving the above damping functions.

In some embodiments, body 1204 may be weighted such that pin 1214 has a tendency to rotate in a given direction to dispose a seat in a vertical position when not in use. In yet other embodiments, body 1204 may be weighted such that pin 1214 has a tendency to rotate and dispose the seat in a horizontal position.

In some embodiments, channel surface 1206 comprises one or more flanges 1208. Flanges 1208 serve as dampers to slow the rotational motion of arm 1220 and pin 1214 by applying frictional force against body 1204. In addition, flanges 1208 soften any sounds emanating from all rotating components, such as arm 1220 and pin 1214. Like tracks 1210, flanges 1208 may comprise silicone or any material suitable to achieve the above damping functions.

In other embodiments, bracket 1202 further comprises stops 1226, 1228 to limit the extent of rotation of pin 1214. Specifically, when arm 1220 contacts one of stops 1226, 1228, pin 1214 is prevented from rotating further in a given direction. Stops 1226, 1228 can also dampen any sounds that occur when pin 1214 rotates from one extreme end rotation to another extreme end of rotation (i.e., when the seat moves from the horizontal position to the vertical position or from the vertical position to the horizontal position).

Figure 13:
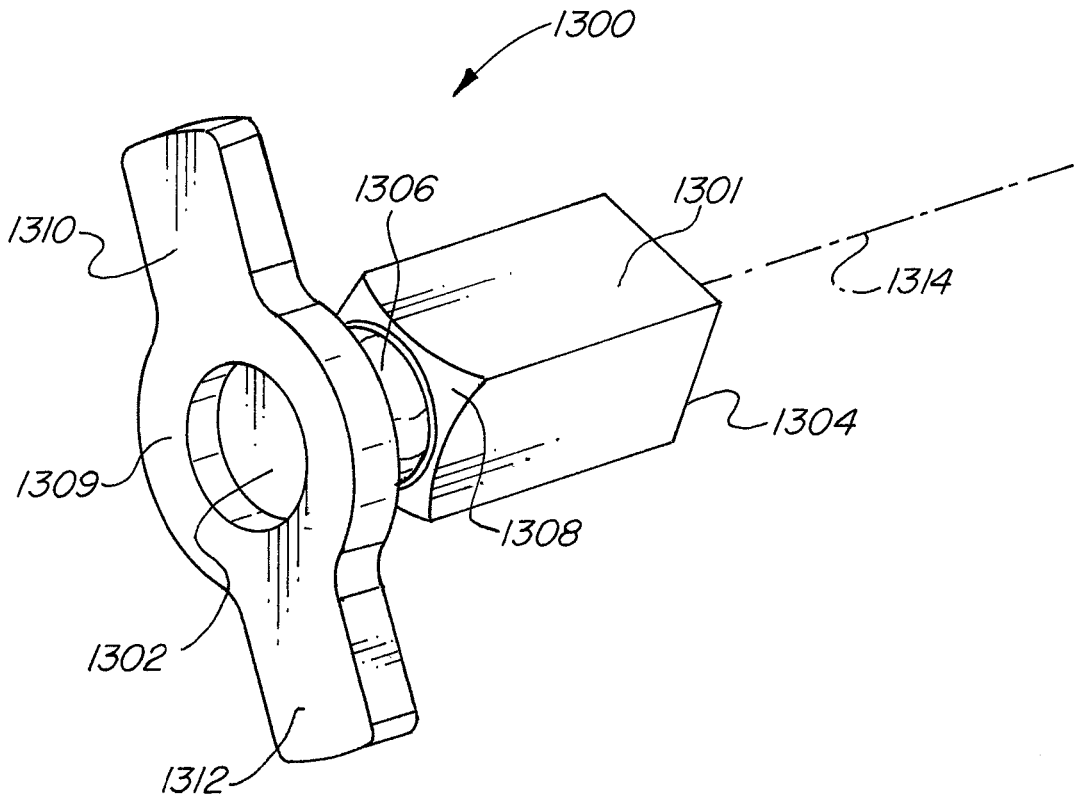
FIG. 13 is a perspective view of a pin assembly according to an embodiment of the present invention.
Figure 14:
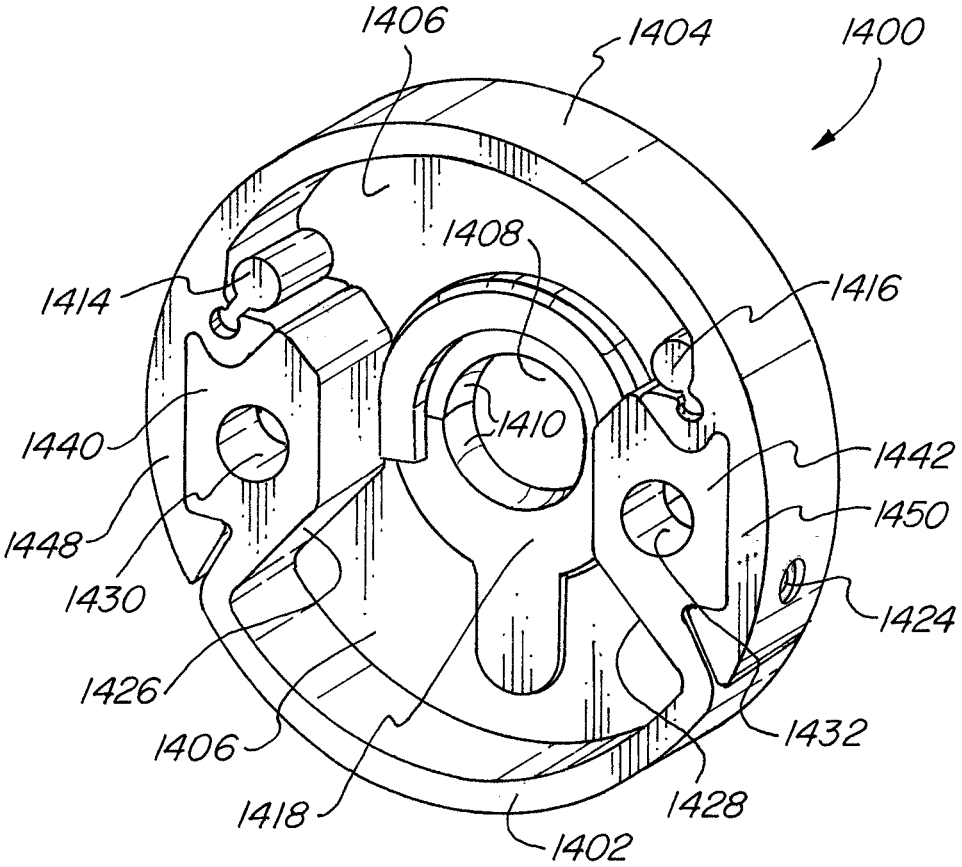
FIG. 14 is a perspective view of a bracket assembly according to an embodiment of the present invention in a closed configuration.

FIG. 13 illustrates a pin assembly 1300 according to yet another embodiment of the present invention. As shown in FIG. 13, the pin 1300 is similar to pin 800 in that it is also adapted with at least one arm. More specifically, pin 1300 comprises a shaft 1301, a distal end 1302 and a proximal end 1304, wherein distal end 1302 has a race member 1306. Shaft 1301 has a noncircular cross-section, which in some embodiments may be triangular, square, rectangular, pentagonal, or other polygonal shape. Shaft 1301 has a contour surface 1308, which in some embodiments may be radiused or rounded in the direction of proximal end 1304. Pin 1300 also includes a stop plate 1309 attached at distal end 1302 and adjacent to a flange (see 110 in FIG. 1) that is disposed on a side of race member 1306 opposite contour surface 1308. The plate 1309 comprises at least two arms extending radially from the race member 1306 at distal end 1302. In the particular embodiment shown in FIG. 13, the plate 1309 comprises two arms 1310, 1312, wherein said arms extend radially outward from race member 1306 in opposite directions. Arms 1310, 1312 each have a free end and further share a common end. The common end serves as the part of the plate 1309 which is mounted to distal end 1302. The shaft 1301 and arms 1310, 1312 are connected such that they form a universal joint, or a similar joint. Further, arms 1310, 1312 are positioned within the same plane relative to each other. In one embodiment, arms 1310, 1312 are disposed perpendicularly with axis 1314 of shaft 1301. The shaft 1301 and arms 1310, 1312 thus form a T-shaped configuration. In other embodiments, arms 1310, 1312 may be disposed on distal end 1302 at slightly off perpendicular with axis 1314. Arms 1310, 1312 may each comprise any shape suitable for controlling the rotation of pin 1300 when disposed within bracket 1400 (FIG. 14). In one embodiment, the shape of arms 1310, 1312 each resemble a bar.

Figure 15:
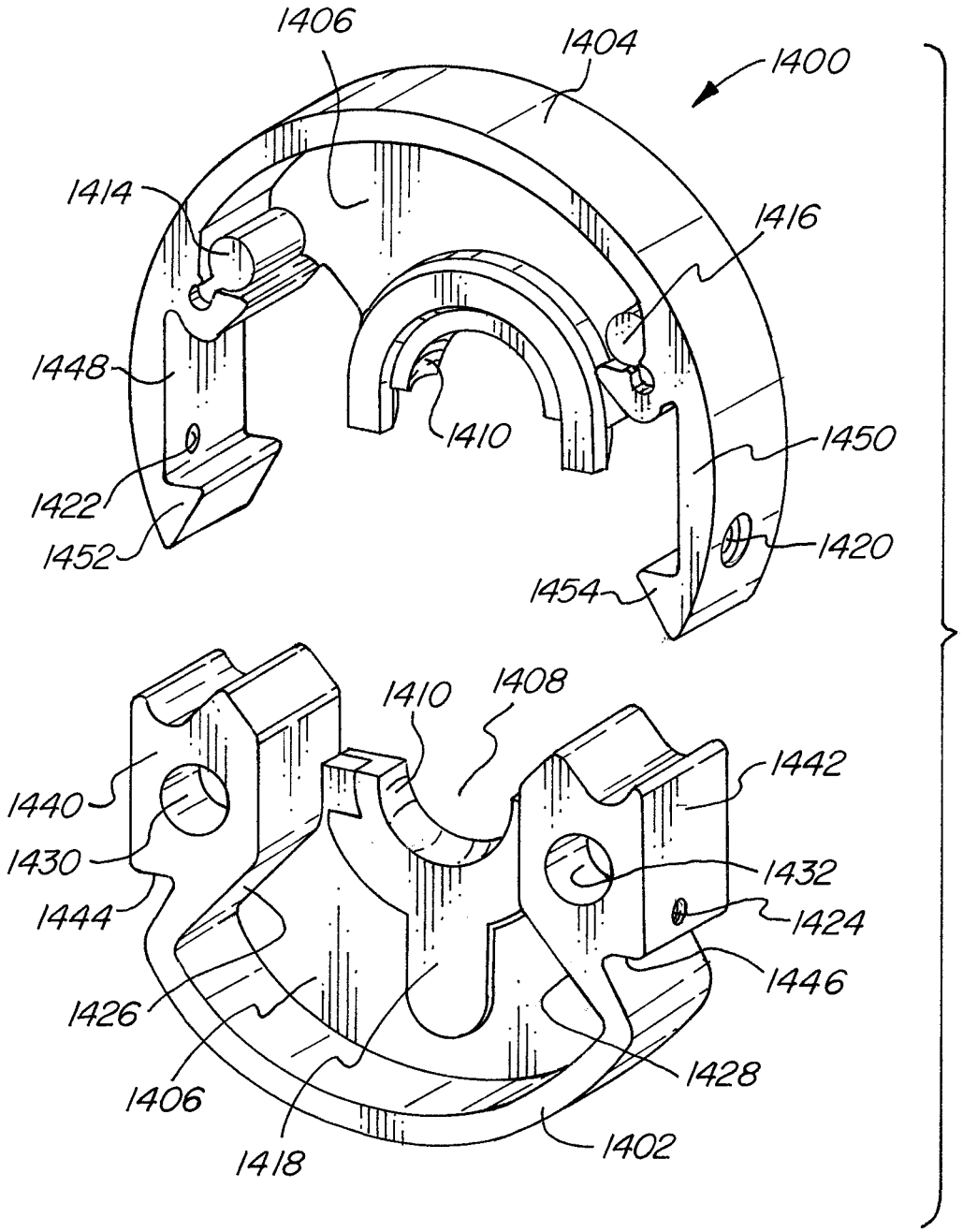
FIG. 15 is a perspective view of the bracket assembly of FIG. 14 in an open configuration.

FIGS. 14-15 illustrate a bracket 1400 according to another embodiment of the hinge mechanism. Bracket 1400 is adapted to be an enclosure for pin 1300, and more specifically the distal end 1302 of pin 1300. Bracket 1400 includes a lower housing 1402 and an upper housing 1404 as well as a socket 1408, wherein portions of socket 1408 are formed in both lower housing 1402 and upper housing 1404. Upper housing 1404 and lower housing 1402 are releasably attached to each other to form bracket 1400. When the two housings are combined, they form a cylindrical shape with a substantially circular cross section, as shown in FIG. 14. In some embodiments, lower housing 1402 is made of a metallic material. The metallic material provides for a more robust housing which can withstand wear and tear and provide increased support and stability as pin 1300 is rotating within socket 1408. However, in other embodiments, the lower housing 1402 may be made of plastic. Similarly, the upper housing 1404 may be created from a metallic material or plastic.

When upper housing 1404 is detached from lower housing 1402, an opening for bracket 1400 to receive distal end 1302 of pin 1300 is provided (FIG. 15). Accordingly, race member 1306 of pin 1300 can be mated to socket 1408. Socket 1408, in particular, includes a bearing surface 1410 which is contoured in complementary shape with race member 1306 so that the surface of race member 1306 is flush with bearing surface 1410. The bracket 1400 further comprises faceplates 1406. One faceplate 1406 is permanently attached to one side of lower housing 1402 while another faceplate 1406 is permanently attached to a corresponding side of upper housing 1404. The attachment between the faceplates and each of the housings creates a seal therebetween. Furthermore, when the upper housing 1404 and the lower housing 1402 are releasably attached to each other, the faceplates 1406 combine with one another to form a seal therebetween.

As illustrated in FIG. 14, the faceplates 1406 comprise socket 1408. Socket 1408, therefore, is formed in both lower and upper housings 1402, 1404, such that upper housing 1404 comprises one portion of socket 1408 while lower housing 1402 comprises another portion of socket 1408. With the two portions of socket 1408 engaging in corresponding fashion, the circular contour of bearing surface 1410 is completed (i.e., a smooth and uniform surface is provided). The portion of socket 1408 disposed in lower housing 1402, designated as element 1418 in FIGS. 14-15, is also adapted to be removably attached to lower housing 1402. This allows for easy removal and replacement of socket portion 1418 in case of repair and maintenance of bracket 1400. For example, if the bearing surface 1410 associated with socket portion 1418 experiences wear and tear, socket portion 1418 can be quickly exchanged with a new socket portion 1418. In some embodiments, the portion of socket 1408 disposed in upper housing 1404 may also be removably attached in order to provide for ease of repair and replacement. The socket portion 1418 may be made of plastic or any material which minimizes friction and minimizes any noise which may be created when a metallic race member 1306 rotates within socket 1408.

In some embodiments, lower and upper housings 1402, 1404 also have backplates (not shown in order to provide detail view of interior of bracket 1400) attached on the side opposite the faceplates 1406. The backplates are configured to be removably attached to the housings. In other embodiments, a single backplate is removably attached both the lower and upper housings 1402, 1404 when in an attached configuration. In order to removably attach the backplate(s) to the housings, two fasteners, such as screws, are inserted through apertures 1430, 1432 provided in lower housing 1402. With the ability to detach and reattach backplate(s) to the housings, easy access to the interior of bracket 1400 is provided. Similar to the faceplates 1406, the backplate(s) creates a seal with housings 1402, 1404. Furthermore, the backplates are similar to backplate 602 (FIG. 6) in that they are adapted to be attached to a leg support.

In order to attach the upper housing 1404 with the lower housing 1402, the lower housing 1402 is adapted with projections 1440, 1442 disposed on opposing sides of the housing, as shown in FIG. 15. Projections 1440, 1442 further comprise recesses 1444, 1446, respectively. Upper housing 1404 is adapted with latches 1448, 1450, which form opposing sides of upper housing 1404. The latches 1448, 1450 respectively have hooks 1452, 1454 disposed at their ends, wherein said hooks project inwardly towards the middle of upper housing 1404. Further, the shapes of hooks 1452, 1454 match the shapes of recesses 1444, 1446, which enables the hooks to be disposed within and secured to the recesses. One process of attaching upper housing 1404 to lower housing 1402 may comprise the steps of aligning upper housing 1404 above lower housing 1402 and subsequently pressing the two housings together. When pressure is applied on upper housing 1404 towards lower housing 1402, the latches 1448, 1450 temporarily deflect out and around projections 1440, 1442, respectively. Once hooks 1452, 1454 are disposed within recesses 1444, 1446, respectively, latches 1448, 1450 cease to be deflected. With this particular attachment process, at least latches 1448, 1450 of upper housing 1404 is made of a flexible material, such as plastic. Another process of attaching the upper housing 1404 to lower housing 1402 comprises the steps of aligning upper housing 1404 next to lower housing 1402 and subsequently sliding upper housing 1404 towards lower housing 1402 such that hooks 1452, 1454 slide into recesses 1444, 1446, respectively. With this attachment process, latches 1448, 1450 do not need to be flexible. In order to detach upper housing 1404 from lower housing 1402, one merely deflects latches 1448, 1450 outward such that hooks 1452, 1454 are no longer disposed within recesses 1444, 1446, and lifts upper housing 1404 in a substantially upward vertical motion. Alternatively, one can slide upper housing 1404 longitudinally relative to lower housing 1402, and thereby release hooks 1452, 1454 from within recesses 1444, 1446.

Upper housing 1404 may further be secured to lower housing 1402, once attached thereto, using a pair of fasteners. A first fastener may be inserted through aperture 1420 disposed in latch 1450 into aperture 1424 of projection 1442 while a second fastener is inserted through aperture 1422 disposed in latch 1448 into aperture 1424 of projection 1440 (FIG. 15). When the two housing are attached to each other, the apertures 1424 align with apertures 1420, 1422. Apertures 1424 may further be adapted with internal threads, such that screws may be used as the fasteners.

In the attached configuration, lower and upper housings 1402, 1404 create a substantially sealed enclosure and thus protect the interior of bracket 1400 and any components disposed therein, such as the distal end 1302 and arms 1310, 1312. The enclosure provides protection for said components against exposure to weather and/or other deteriorating elements. When the bracket 1400 is in an open or detached configuration, i.e. upper housing 1404 removed from lower housing 1402, access to socket 1408 for inserting pin 1300 is provided. In addition, the detached configuration provides access to the interior of bracket 1400 for maintenance and/or repair, including the adjustment or alignment of pin 1300 relative to bracket 1400.

Bracket 1400 also comprises stops 1414, 1416, which exhibit the same characteristics as stops 214, 216, 1008, 1010. Stops 1414, 1416 regulate the rotational motion of pin 1300 with arms 1310, 1312 when race member 1306 mates with socket 1408. Accordingly, when a seat bottom is telescopically connected to pin 1300 (FIGS. 4-5), stop 1414 prevents the rotation of the seat bottom past a vertical position. When use of the seat bottom is required, it is rotated to a horizontal position. Stop 1416 prevents rotation of the seat bottom past the horizontal position. Given the above configuration, stops 1414, 1416 define the extent pin 1300 and the seat bottom can rotate in either direction (i.e., clockwise or counter-clockwise). Stops 1414, 1416 may further regulate the speed at which pin 1300 rotates and thus controls the rotational speed of the seat bottom. Moreover, stops 1414, 1416 have damping characteristics to prevent any recoil, backlash, or vibration in the seat bottom when it rotates from one position to another (e.g., horizontal position, vertical position). The damping characteristics of stops 1414, 1416 also help reduce any noise created by pin 1300 and/or bracket 1400 when the seat bottom rotates between different positions. Stops 1414, 1416 may comprise of silicone, rubber or any material demonstrating similar damping characteristics. Further, stops 1414, 1416 are adapted to be removably attached within the upper housing 1404. This allows for easy replacement of stops 1414, 1416, in repair and maintenance situations, without requiring disassembly of bracket 1400 from a leg support mounted thereto.

Bracket 1400 may further comprise additional stops 1426, 1428. Like stops 1414, 1416, stops 1426, 1428 assist in regulating the rotational motion of pin 1300, regulating the rotational speed of pin 1300, and providing damping to prevent recoil or backlash during rotation. In some embodiments, stops 1426, 1428 can be removably attached to lower housing 1402. In other embodiments, stops 1426, 1428 can be integrated into or formed as a part of the lower housing 1402, as shown in FIGS. 14-15.

Figure 16:
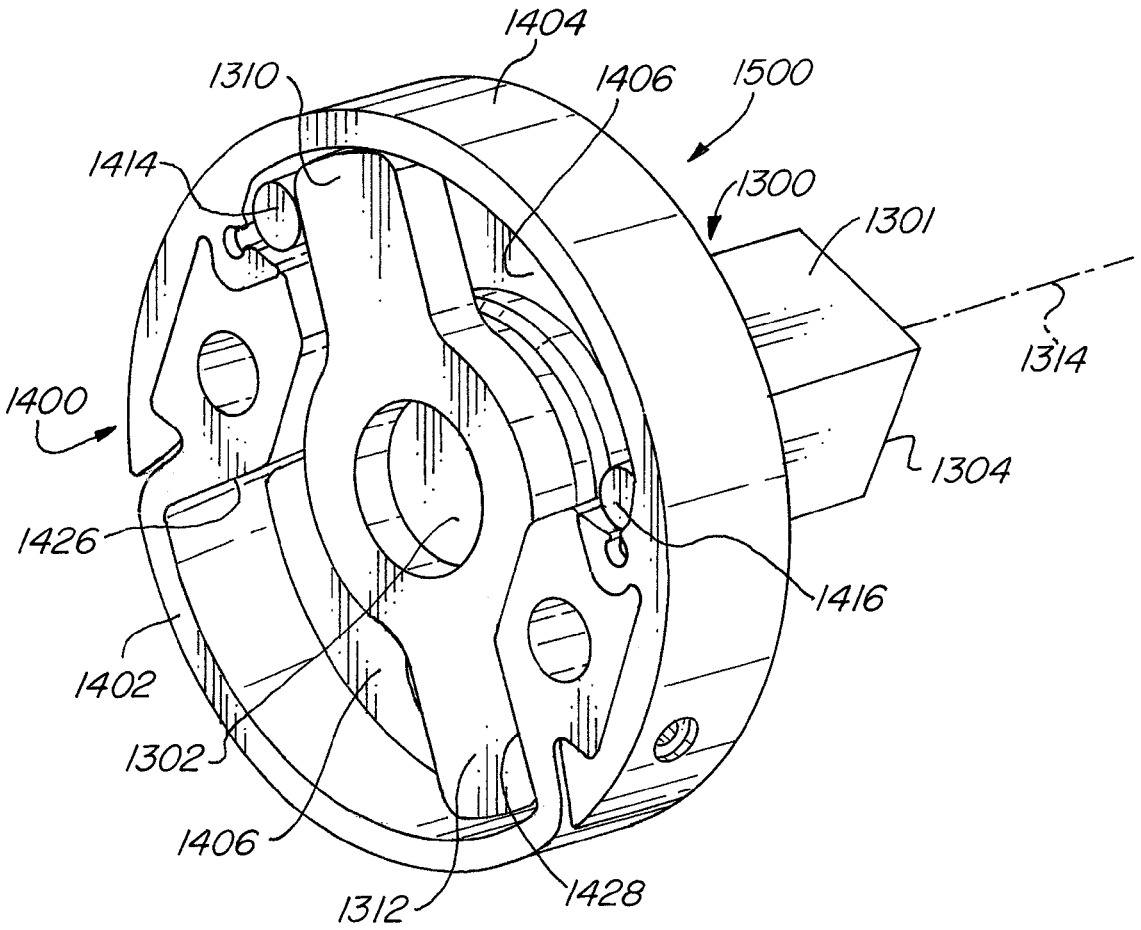
FIG. 16 is a perspective view of a hinge assembly comprising the pin of FIG. 13 and the bracket of FIG. 14 according to an embodiment of the present invention.
Figure 17:
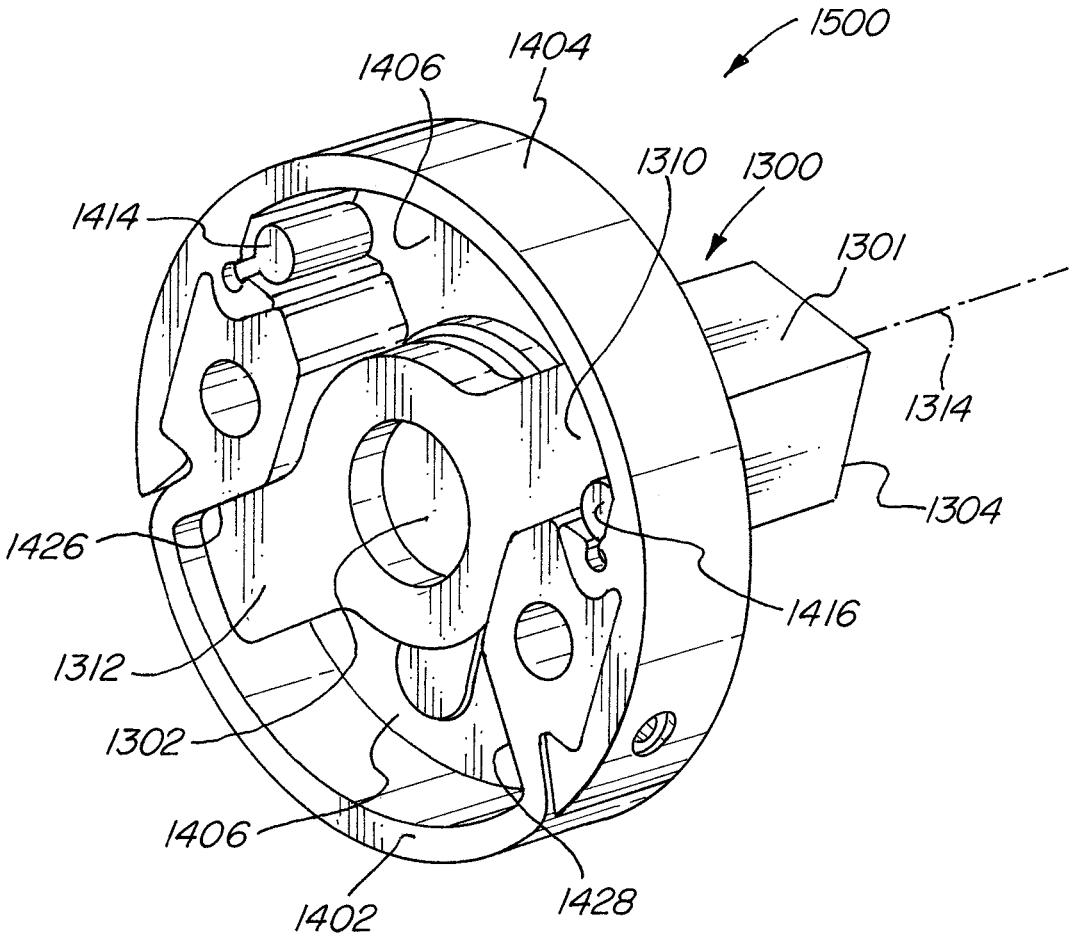
FIG. 17 is a perspective view of the hinge assembly of FIG. 16 according to an embodiment of the present invention.

FIGS. 16-17 illustrate a hinge assembly 1500 according to an embodiment of the invention. Hinge assembly 1500 includes bracket 1400 and pin 1300 inserted therein, such that race member 1306 is disposed within socket 1408 and shaft 1301 is disposed outside bracket 1400. Shaft 1301 of pin 1300 has an axis 1314 that is perpendicular to faceplates 1406. However, axis 1314 can deviate several degrees from perpendicular without creating any interference between bracket 1400 and pin 1300 as the pin rotates (see FIG. 11). When pin 1300 is inserted into bracket 1400, arms 1310, 1312 are disposed within bracket 1400 such that arms 1310, 1312 limit the rotation of pin 1300 about axis 1314. In some embodiments, the total sweep of rotation of pin 1300 and arms 1310, 1312 is between 80 and 90 degrees. As shown in FIG. 16, pin 1300 is at one extreme end of its rotation sweep with arm 1310 contacting stop 1414 and arm 1312 contacting stop 1428. Stops 1414 and 1428 prevent arms 1310 and 1312, respectively, from rotating further in a counter-clockwise direction. Conversely, as shown in FIG. 17, pin 1300 is at the opposite extreme end of its rotation sweep, with arm 1310 contacting stop 1416 and arm 1312 contacting stop 1426. Stops 1416 and 1426 prevent arms 1310 and 1312, respectively, from rotating further in a clockwise direction. As contact is made between arms 1310, 1312 and stops 1414, 1416, 1426, 1428, the stops absorb the impact of the arms and eliminate any recoil, backlash, or vibrations in pin 1300. In addition, the stops dampen any sound created by pin 1300 when it rotates or comes to a complete stop at one extreme end of rotation. The configuration of more than one arm disposed at the distal end 1302 of pin 1300 provides a stronger hinge mechanism, greater control in rotation of pin 1300, and better vibration damping characteristics.

As one of ordinary skill will understand from the preceding description, the present invention provides a novel hinge mechanism that can accommodate a variety of seat widths and allow easy removal and replacement of a seat bottom as well as simple adjustment of the seat bottom while still supporting an occupant's weight. Further, the novel hinge in the preceding description accommodates a variety of seat widths without requiring the leg frames to be moved or replaced. The preceding description further provides a hinge that can accommodate an auditorium having both straight and curved sections of seating where some support legs are mounted parallel and others non-parallel to each other. The hinge of the preceding description also provides a suitable range of adjustability to accommodate arcuate seating of varying curvature. The novel hinge additionally can withstand weather and elements that may be present in outdoor locations.

Although the invention has been described with reference to a particular arrangement of parts, features and the like, these are not intended to exhaust all possible arrangements or features, and indeed many modifications and variations will be ascertainable to those of skill in the art.

What is claimed is:

1. A hinge mechanism, comprising:

a pin having a proximal end and a distal end, said pin including a shaft with a non-circular cross-section extending along a longitudinal axis from the proximal end to an at least partially spherical race member disposed about the longitudinal axis, said pin further including at least one arm mounted distal to the race member and extending perpendicular to the longitudinal axis, the proximal end of the shaft adapted to slidably engage into and form a telescopic connection with an aperture having a noncircular cross-section;

a bracket having a socket;

wherein said bracket is adapted to receive and axially retain said distal end of said pin, wherein said race member mates with said socket, the at least one arm is disposed within an interior of said bracket, and said shaft is disposed outside said bracket upon receipt of said distal end into said bracket; and said pin is rotatable within said socket.

2. The hinge mechanism of claim 1, wherein the at least partial sphere includes opposing sides parallelly truncated.

3. The hinge mechanism of claim 1, further comprising:

a seat brace, said seat brace including said aperture;

wherein said seat brace receives said shaft in said aperture and said shaft is not rotatable within said seat brace.

4. The hinge mechanism of claim 1, wherein said telescopic connection comprises a fitted arrangement between said shaft of said pin and said aperture of said seat brace, said fitted arrangement providing tolerance for adjustment and alignment of said pin relative to said seat brace.

5. The hinge mechanism of claim 3, further comprising a seat bottom attached to said seat brace, wherein said seat bottom is rotatable with said pin.

6. The hinge mechanism of claim 1, the bracket comprising:

a housing;

a backplate removably attached to a first side of said housing; and a faceplate attached to a second side of said housing opposing said backplate; wherein said backplate and faceplate each form a seal with said housing;

said backplate, faceplate, and housing create an enclosure around said distal end; and said faceplate comprises said socket.

7. The hinge mechanism of claim 6, wherein said bracket comprises a latch, said latch providing an opening for said bracket to receive said distal end of said pin.

8. The hinge mechanism of claim 6, further comprising:

a leg support, said backplate is attached to said leg support;

wherein said leg support, backplate, bracket, and pin are adapted to provide weight-bearing support.

9. The hinge mechanism of claim 6, wherein said backplate contacts said distal end of said pin, said contact applies pressure against said distal end to ensure constant mating between said race member and said socket.

10. The hinge mechanism of claim 1, wherein said shaft of said pin extends perpendicularly from said socket.

11. The hinge mechanism of claim 10, wherein said shaft of said pin is adapted to pivot up to 5 degrees from perpendicular of said socket without prohibiting said pin from being rotatable within said socket.

12. The hinge mechanism of claim 1, wherein the non-circular cross-section of said shaft is selected from the group consisting of triangle, square, rectangle and pentagonal.

13. The hinge mechanism according to claim 1, wherein:

the at least one arm includes two arms mounted substantially adjacent to said race member at said distal end, said arms extending radially from said pin.

14. The hinge mechanism of claim 13, wherein said bracket comprises an upper housing releasably attached to a lower housing, said upper housing is adapted to provide an opening for said bracket to receive said distal end of said pin when detached from said lower housing.

15. The hinge mechanism of claim 14, wherein:

said upper housing and lower housing of said bracket form a circular shape; and said lower housing includes a first portion of said socket and said upper housing includes a second portion of said socket, said first portion and second portion engage each other to form said socket.

16. The hinge mechanism of claim 15, wherein said first portion of said socket is releasably attached to said lower housing.

17. The hinge mechanism of claim 13, wherein said arms are disposed within an interior of said bracket when said race member mates with said socket, and said arms are rotatable with said pin.

18. The hinge mechanism of claim 13, wherein said bracket further comprises at least two stops, said stops releasably attached within an interior of said bracket; and said pin is rotatable until at least one of said arms impacts one of the at least two stops at a desired limit of rotation, said one of the at least two stops prevents said pin from rotating past said desired limit of rotation.

19. The hinge mechanism of claim 18, wherein said pin is rotatable until said arms each impact one of the at least two stops, said stops impacted by said arms prevent said pin from rotating past said desired limit of rotation.

20. The hinge mechanism of claim 13, further comprising a seat brace, said seat brace having an aperture;

wherein said seat brace is adapted to receive said shaft in said aperture, said seat brace and said shaft disposed within said aperture form a telescopic connection, and said telescopic connection provides lateral movement of said shaft with respect to said seat brace; and wherein said shaft is not rotatable within said seat brace.

21. A hinge mechanism, comprising:

a pin having a proximal end and a distal end, said proximal end having a shaft with a non-circular cross-section;

a race member disposed at said distal end; and a bracket having a socket;

wherein said bracket receives and axially retains said distal end of said pin, said race member mates with said socket, and said shaft is disposed outside said bracket upon receipt of said distal end into said bracket;

said pin is rotatable within said socket;

a seat brace, said seat brace having an aperture, wherein said seat brace receives said shaft in and form a telescopic connection with said aperture and said shaft is not rotatable within said seat brace; and a seat bottom attached to said seat brace, wherein said seat bottom is rotatable with said pin, wherein said seat bottom is rotatable between a horizontal seating position and a vertical seating position.

22. The hinge mechanism of claim 21, further comprising:

an arm mounted on said pin substantially adjacent and distal to the race member, said arm being disposed within an interior of said bracket when said race member mates with said socket; and said arm being rotatable with said pin.

23. The hinge mechanism of claim 22, wherein said arm is mounted perpendicularly with said pin.

24. A hinge mechanism, comprising:

a pin having a proximal end and a distal end, said proximal end having a shaft with a non-circular cross-section;

a race member disposed at said distal end;

at least one arm mounted distal to the race member on said pin and extending perpendicular to said pin;

a bracket having a socket; and a seat bottom comprising at least one seat brace having an aperture;

wherein said bracket receives and axially retains said distal end of said pin, said race member mates with said socket, the at least one arm is disposed within an interior of said bracket, and said shaft is disposed outside said bracket upon receipt of said distal end into said bracket;

said seat brace receives said shaft in said aperture, said shaft is not rotatable within said seat brace, said seat brace and said shaft form a telescopic connection; and said pin is rotatable within said socket to provide for said seat bottom to rotate into one of a vertical or horizontal seating position.

25. The hinge mechanism of claim 24, wherein said arm rotates with said pin.

26. The hinge mechanism of claim 25, wherein said bracket further comprises at least one stop, said stop disposed within the interior of said bracket; and wherein said arm impacts the at least one stop at a desired limit of rotation of said pin, and when said arm impacts said stop, said pin is prevented from rotating past said desired limit of rotation.

27. The hinge mechanism of claim 26, wherein the at least one stop is adapted to absorb the impact of said arm with said stop and prevent backlash of said pin.

28. The hinge mechanism of claim 26, wherein the desired limit of rotation defines said seat bottom in said horizontal seating position.

29. The hinge mechanism of claim 26, wherein the desired limit of rotation defines said seat bottom in said vertical seating position.

30. The hinge mechanism of claim 24, wherein said telescopic connection comprises a fitted arrangement between said shaft of said pin and said aperture of said seat brace, said fitted arrangement providing tolerance for adjustment and alignment of said pin relative to said seat brace.

31. The hinge mechanism of claim 30, wherein said shaft of said pin extends perpendicularly from said socket.

32. The hinge mechanism of claim 31, wherein said shaft of said pin is adapted to pivot up to 5 degrees from a perpendicular of said socket without prohibiting said pin being rotatable within said socket.

33. A hinge mechanism, comprising:

a pin having a proximal end and a distal end, said proximal end comprising a shaft, said shaft having a polygonal cross section;

a race member disposed at said distal end;

an arm mounted substantially adjacent to said race member at said distal end;

a bracket having a socket and at least two stops, said stops disposed within an interior of said bracket; and a seat bottom comprising at least one seat brace having an aperture;

wherein said bracket receives said distal end of said pin;

said race member mates with said socket, said arm is disposed within the interior of said bracket and said shaft is disposed outside said bracket upon receipt of said distal end into said bracket;

said seat brace receives said shaft in said aperture, said shaft is not rotatable within said seat brace, said seat brace and said shaft form a telescopic connection;

said pin is rotatable within said socket and said arm is rotatable with said pin to provide for rotation of said seat bottom;

said shaft is adapted to extend 0 to 5 degrees from a perpendicular of said socket without prohibiting said pin being rotatable within said socket;

said pin is rotatable until said arm impacts one of the at least two stops at a desired limit of rotation, said one of the at least two stops prevents said pin from rotating past said desired limit of rotation, said desired limit of rotation defines a seat position.

34. The hinge mechanism of claim 33, wherein said at least two stops are adapted to absorb the impact of said arm with said stops and prevent backlash of said arm.

35. The hinge mechanism of claim 33, further comprising:

a backplate removably attached to a first side of said bracket; and a faceplate attached to a second side of said bracket opposing said backplate;

said backplate, faceplate, and bracket create an enclosure around said distal end; and said faceplate comprises said socket.

36. The hinge mechanism of claim 35, wherein said bracket comprises a latch, said latch providing an opening for said bracket to receive said distal end of said pin.

37. The hinge mechanism of claim 35, further comprising:

a body removably attached to said arm at an end furthest from a point of rotation of said arm;

at least one track disposed on an inner surface of said faceplate; and said body comprising at least one groove adapted to receive said at least one track;

wherein said groove and said track decelerate the rotational motion of said body, arm, pin, and seat bottom.

38. The hinge mechanism of claim 37, further comprising:

a channel surface disposed in the interior of said bracket, said channel surface providing a channel in which said arm and said body rotate;

said channel surface comprising at least one flange, said flange is adapted to decelerate the rotational motion of said body, arm, pin, and seat bottom.

39. A row of seats, comprising;

two or more seats;

each of said seats comprising a seat bottom having at least one seat brace having an aperture, at least one leg support having a backplate, and at least one hinge mechanism removably attached to said backplate;

said hinge mechanism comprising:

a pin having a proximal end and a distal end, said pin including a shaft with a non-circular cross-section extending along a longitudinal axis from the proximal end to an at least partially spherical race member disposed about the longitudinal axis, said pin further including at least one arm mounted distal to the race member and extending perpendicular to the longitudinal axis, the proximal end of the shaft adapted to slidably engage into and form a telescopic connection with an aperture having a noncircular cross-section;

a bracket having a socket;

wherein said bracket receives and axially retains said distal end of said pin, wherein said race member mates with said socket, the at least one arm is disposed within an interior of said bracket, and said shaft is disposed outside said bracket upon receipt of said distal end into said bracket;

said seat brace receives said shaft in said aperture, said shaft is not rotatable within said seat brace, said seat brace and said shaft form a telescopic connection;

said telescopic connection comprises a fitted arrangement between said pin and said seat brace, said fitted arrangement providing tolerance for adjustment and alignment of said pin relative to said seat brace; and said pin is rotatable within said socket to provide for said seat bottom to rotate into one of a vertical or horizontal seating position.

40. The row of seats of claim 39, wherein said seats are disposed substantially adjacent to each other and are positioned in a linear configuration; and said linear configuration comprises said seats facing a common direction and said at least one leg support of each seat being positioned substantially parallel to each other.

41. The row of seats of claim 40, wherein said shaft of said pin extends perpendicularly from said socket.

42. The row of seats of claim 39, wherein said seats are disposed substantially adjacent to each other and are positioned in an arcuate configuration;

said arcuate configuration comprises said at least one leg support of each seat being positioned non-parallel to each other.

43. The row of seats of claim 42, wherein said shaft extends off perpendicular from said socket without prohibiting said pin being rotatable within said socket.

44. The row of seats of claim 39, wherein said bracket further comprises a latch, said latch providing an opening for removably inserting said distal end of said pin into said bracket;

said opening providing for removal and replacement of said seat bottom.

* * * * *